US007079125B2

(12) United States Patent
Nakagawa et al.

(10) Patent No.: US 7,079,125 B2
(45) Date of Patent: Jul. 18, 2006

(54) DISPLAY DEVICE DRIVING CIRCUIT AND DISPLAY DEVICE

(75) Inventors: Hirofumi Nakagawa, Kyoto (JP); Osamu Sarai, Osaka (JP); Fuminori Tanemura, Osaka (JP); Miki Fujino, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 367 days.

(21) Appl. No.: 10/607,997

(22) Filed: Jun. 30, 2003

(65) Prior Publication Data

US 2004/0041826 A1 Mar. 4, 2004

(30) Foreign Application Priority Data

Aug. 29, 2002 (JP) ..... 2002-251876

(51) Int. Cl.
*G09G 5/00* (2006.01)
*G09G 3/36* (2006.01)

(52) U.S. Cl. ..... 345/209; 345/96

(58) Field of Classification Search ..... 345/209, 345/87, 98, 100, 96
See application file for complete search history.

(56) References Cited

U.S. PATENT DOCUMENTS

| | | | | |
|---|---|---|---|---|
| 6,304,241 | B1 * | 10/2001 | Udo et al. | 345/96 |
| 6,924,782 | B1 * | 8/2005 | Fujioka et al. | 345/92 |
| 2002/0008687 | A1 | 1/2002 | Tazuke | |
| 2002/0050972 | A1 * | 5/2002 | Udo et al. | 345/96 |

FOREIGN PATENT DOCUMENTS

| | | | |
|---|---|---|---|
| EP | 1 202 245 | A2 | 5/2002 |
| JP | 11-95729 | | 4/1999 |
| JP | 11095729 | A * | 4/1999 |
| JP | P2000-39870 | A | 2/2000 |
| JP | P2000-98976 | A | 4/2000 |

* cited by examiner

*Primary Examiner*—Amr A. Awad
*Assistant Examiner*—Stephen Sherman
(74) *Attorney, Agent, or Firm*—McDermott Will & Emery LLP

(57) ABSTRACT

A signal line driving circuit includes an output section $out_N$ (where N is a natural number) for supplying an image-forming signal for red, green or blue to a sub-pixel of a display section, a voltage supply line $S_N$ connected to the output section $out_N$, and a shorting line for electrically shorting output sections of the same color with each other during a predetermined period. By shorting output sections of the same color with each other, the charge stored in a panel-side load can be effectively redistributed to another panel-side load, thereby realizing a power conserving effect.

14 Claims, 17 Drawing Sheets

DISPLAY DEVICE DRIVING CIRCUIT AND DISPLAY DEVICE

BACKGROUND OF THE INVENTION

The present invention relates to a display device driving circuit, and more particularly to a driving circuit for a liquid crystal display device used in a dot inversion driving mode.

Liquid crystal display (LCD) devices are now a major class of image display devices for they have a reduced power consumption and take less space as compared with CRTs, etc. Among the various types of liquid crystal display devices, those of an active matrix type using TFTs (Thin Film Transistors) are used as personal computer displays and TV screens, as they have high definitions and can be made in large screen sizes.

FIG. 14 is a circuit diagram illustrating a conventional full-color liquid crystal display device.

As illustrated in FIG. 14, the conventional liquid crystal display device includes a signal line driving circuit 110, a scanning line driving circuit 112 and a display section (liquid crystal panel).

The display section includes a plurality of signal lines 152*a*, 152*b*, 152*c*, . . . , (hereinafter referred to collectively as "signal lines 152") extending in the column direction (the vertical direction in the figure) from the signal line (source) driving circuit 110, a plurality of scanning lines (gate lines) 151*a*, 151*b*, 151*c*, . . . , (hereinafter referred to collectively as "scanning lines 151") extending in the row direction (the horizontal direction in the figure) from the scanning line (gate line) driving circuit 112, and sub-pixels 153 arranged in a matrix pattern. Each sub-pixel 153 is located near one of a plurality of intersections between the signal lines 152 and the scanning lines 151. Moreover, each sub-pixel 153 includes a liquid crystal cell 155, a hold condenser 156 and a TFT 154. The liquid crystal material in the liquid crystal cell 155 is interposed between a pixel electrode and a counter electrode. Herein, the term "sub-pixel" is used to refer to a component of one pixel, and each sub-pixel is used to produce one of the following colors: red (R), green (G) and blue (B).

The signal line driving circuit 110 is normally a multiple-output integrated circuit, and supplies output voltages Vout1, Vout2, Vout3, . . . , to the source electrodes of the TFTs 154. Note that although transfer gates TG101*a*, TG101*b*, . . . , are shown in FIG. 14 to be outside the adjacent signal line driving circuit 110, they are actually provided inside the signal line driving circuit 110. Nevertheless, the transfer gates TG101*a*, TG101*b*, . . . , may alternatively be provided on the panel side. Each transfer gate TG101 electrically connects output sections of the signal line driving circuit 110 with each other, as will be described later.

Moreover, also the scanning line driving circuit 112 is normally a multiple-output integrated circuit, and supplies output voltages to the gate electrodes of the TFTs 154.

In the liquid crystal display device, the scanning line driving circuit 112 selects the sub-pixels 153 by rows while the signal line driving circuit 110 supplies an image-forming signal in the form of a voltage. Note that for full-color display, signal lines 152 include groups of signal lines for R (red), G (green) and B (blue).

In a liquid crystal display device as described above, an after-image phenomenon called "burn-in" occurs if a DC voltage is applied over a long period of time. Therefore, it is necessary to invert the voltage applied across the liquid crystal material at predetermined intervals. Such a driving mode is called "frame inversion driving mode".

The frame inversion driving mode includes a line inversion driving mode, a dot inversion driving mode, etc.

A dot inversion driving mode is a driving mode in which voltages of opposite polarities are applied to adjacent sub-pixels, and is capable of better suppressing flicker on the screen than with the line inversion driving mode.

FIG. 15 illustrates a portion of a conventional signal line driving circuit employing a dot inversion driving mode. Particularly, FIG. 15 illustrates the output circuit of the signal line driving circuit.

Image-forming signals and gray scale signals are input to the signal line driving circuit from an image signal processing circuit (not shown) and a gray scale voltage generation circuit (not shown), respectively. Then, output voltages Vout1, Vout2, . . . , according to the gray scale signals are output from the output circuit of the signal line driving circuit.

As illustrated in FIG. 15, the output circuit of the conventional signal line driving circuit includes operational amplifiers Amp101 and Amp102, output sections out1 and out2, a voltage supply line S1 connecting the output section of the operational amplifier Amp101 to the output section out1, a voltage supply line S2 connecting the output section of the operational amplifier Amp102 to the output section out2, a switch SW1 provided along the voltage supply line S1, a switch SW2 provided along the voltage supply line S2, and the transfer gate TG101 provided between the voltage supply line S1 and the voltage supply line S2 for shorting the output section out1 with the output section out2. Although only two adjacent output sections are shown in the figure, an actual output circuit includes an array of multiple output sections connected to multiple voltage supply lines.

Next, the operation and the function of the conventional signal line driving circuit will be described.

FIG. 16 is a timing chart illustrating voltage transitions at various points in the conventional output circuit.

As illustrated in FIG. 16, in a dot inversion driving mode, voltages Vout1 and Vout2 of the adjacent output sections out1 and out2 are voltages of opposite polarities with respect to a common voltage Vcom. The polarities of the output sections out1 and out2 are inverted with respect to Vcom for every horizontal scanning period H.

When driving the liquid crystal display device, the parasitic capacitance of the signal line 152 illustrated in FIG. 14, the capacitance of the hold condenser 156, the liquid crystal capacitance of the liquid crystal cell 155, etc., occur as load capacitances. The current for driving the load capacitances constitutes a part of the total power consumption of the liquid crystal display device. In view of this, the conventional signal line driving circuit includes the switches SW1 and SW2, and the transfer gate TG101 for shorting the adjacent output sections out1 and out2 with each other, so as to reduce the power consumption. The effect of reducing the power consumption will now be described along with the description of the operation of the circuit.

With the conventional signal line driving circuit employing a dot inversion driving mode, the horizontal scanning period H includes a period B and a period A, as illustrated in FIG. 16.

First, in a horizontal scanning period H1, when the polarities of output voltages Vo1 and Vo2 of the operational amplifiers Amp101 and Amp102 transition from (+) and (−) to (−) and (+), respectively, the switches SW1 and SW2 are both turned OFF during the period B. During the period B, the transfer gate TG101 is turned ON, thereby electrically shorting the output section out1 with the output section out2. Moreover, during the period B, the polarity of the output voltage Vo1 of the operational amplifier Amp101 transitions to (−), and that of the output voltage Vo2 of the operational amplifier Amp102 transitions to (+).

On the panel side, there are load capacitances connected respectively to the output sections out1 and out2. The load connected to the output section out1 whose output voltage has been (+) until immediately before the period B has a larger charge than the load connected to the output section out2. Therefore, with the transfer gate TG101 being ON, a current I flows from the load connected to the output section out1 to the load connected to the output section out2 during the period B. In this period, the switches SW1 and SW2 are OFF, whereby the potential of the output section out1 can be brought closer to that of the output section out2 without consuming power.

Next, in the period A, the switches SW1 and SW2 are both turned ON, and the transfer gate TG101 is turned OFF. Thus, as illustrated in FIG. 16, the output sections of the operational amplifiers Amp101 and Amp102 are connected respectively to the output sections out1 and out2. Then, the load connected to the output section out1 discharges a current flowing from the output section out1 to the operational amplifier Amp101, and the load connected to the output section out2 is charged with the current flowing from the operational amplifier Amp102 to the output section out2. Thus, Vout1 and Vout2 are turned (−) and (+), respectively, with a slight delay from the start of the period A.

In the period A, a current flows through the operational amplifiers Amp101 and Amp102, thereby consuming some power. However, the power consumption can be reduced because the charge is distributed between adjacent loads in the liquid crystal display device in the period B.

This effect is obtained also in the following period, i.e., a horizontal scanning period H2. Specifically, in the period B, the switches SW1 and SW2 are turned OFF, and the transfer gate TG101 is turned ON, whereby the current I flows through the transfer gate TG101 in the direction opposite to that during the horizontal scanning period H1, and the charge is distributed from the load connected to the output section out2 to the load connected to the output section out1.

Then, during the period A in the horizontal scanning period H2, the switches SW1 and SW2 are turned ON, and the transfer gate TG101 is turned OFF. Thus, the load connected to the output section out1 is charged with the current output from the operational amplifier Amp101, and the load connected to the output section out2 discharges a current flowing from the output section out2 to the operational amplifier Amp102.

The operation as described above is repeated in the conventional signal line driving circuit.

As described above, the conventional signal line driving circuit aims at conserving power in a dot inversion driving mode. Such a configuration where outputs of a signal line driving circuit are shorted with each other is described in, for example, Japanese Laid-Open Patent Publication Nos. 11-95729 and 2000-39870.

FIG. 17 is a block diagram schematically illustrating the mask layout of the output circuit in the conventional signal line driving circuit.

The conventional signal line driving circuit described above is provided in the form of a single chip onto which about 384 outputs, for example, are integrated.

The circuit layout is as illustrated in FIG. 17. When there are n outputs (where n is a natural number), n operational amplifiers are arranged in a row, and the output sections connected respectively to the adjacent operational amplifiers are arranged in a row in the same order as that of the operational amplifiers. One transfer gate for shorting output sections with each other is provided for each pair of operational amplifiers, and the transfer gates are arranged in the same order as those of the operational amplifiers and the output sections.

Note that in a full-color liquid crystal display device, these components are arranged in a repeating pattern of three colors, e.g., R-G-B-R-G-B . . . . Therefore, in the conventional signal line driving circuit, output sections of different colors are shorted with each other, e.g., R (red) with G (green), or B (blue) with R.

As illustrated in FIG. 16, with the conventional signal line driving circuit, the charge of a load can be effectively distributed if the voltages Vout1 and Vout2 both reach equilibrium within an amount of time that is sufficiently shorter than the period B.

However, in a liquid crystal display device having a large size, for example, a signal line has a large load capacitance, and a longer time is required for charging. In such a case, the period B ends before Vout1 and Vout2 reach equilibrium, whereby the charge of the load is not sufficiently redistributed. Therefore, the amount of charge supplied from the signal line driving circuit increases, thereby decreasing the effect of reducing the power consumption.

If the amount of charge supplied from the signal line driving circuit increases, an increasing amount of heat is generated in the IC chip of the signal line driving circuit, whereby the circuit operation may be hindered by heat.

Moreover, in the conventional signal line driving circuit, output sections of different colors are shorted with each other, whereby the power consumption reducing effect is not sometimes obtained sufficiently depending on the image being displayed on the screen.

For example, in a case where an R output section (i.e., an output section through which R level data is output) and a G output section (i.e., an output section through which G level data is output) are shorted with each other, although the power consumption is reduced in a solid white display or a solid black display where the R level and the G level are equal to each other, the power consumption is not sufficiently reduced in a solid red display.

As described above, with the conventional signal line driving circuit, there is still a room for further reduction in the power consumption. Particularly, the power consumption reducing effect may not be sufficient for cases where the load capacitance on the panel side is large.

SUMMARY OF THE INVENTION

It is an object of the present invention to provide a display device in which the power consumption is further reduced, and a display device driving circuit for realizing such a display device.

A first display device driving circuit of the present invention is a display device driving circuit for use with a display device having a display section including sub-pixels arranged in a matrix pattern and a plurality of signal lines for supplying image-forming signals to the sub-pixels, the display device driving circuit including: voltage supply lines for transferring the image-forming signals to the plurality of signal lines; switches for turning ON/OFF the transfer of the image-forming signals to the voltage supply lines; and shorting means for electrically shorting one of the voltage supply lines that is connected to an odd-numbered one of the plurality of signal lines with another one of the voltage supply lines that is connected to an even-numbered one of the plurality of signal lines during a predetermined period including a period during which the switches are OFF, wherein the shorting means can be turned OFF autonomously when a polarity of a potential of the voltage supply line connected to the odd-numbered signal line and a polarity of a potential of the voltage supply line connected to the even-numbered signal line are switched around.

With such a configuration, the driving circuit can be controlled so that the connection means is turned OFF autonomously when the polarity of the potential of a voltage supply line connected to the odd-numbered signal line and the polarity of the potential of a voltage supply line connected to the even-numbered signal line are switched around, whereby the connection means can be kept ON until the distribution of charge between a load on the display section side including the odd-numbered signal line and a load on the display section side including the even-numbered signal line is completed. As a result, it is possible to reduce the amount of current flowing from the display device driving circuit to the display section.

In one embodiment, the odd-numbered signal line and the even-numbered signal line are adjacent to each other. In this way, when the display device driving circuit is used with a display device operated in a dot inversion driving mode, signal lines receiving image-forming signals of different polarities can be shorted with each other, whereby the redistribution of charge between loads on the display section side can be done efficiently.

In one embodiment, the voltage supply lines are all electrically shorted together during the predetermined period. In this way, the potential of a voltage supply line is brought closer to the average potential of all voltage supply lines, whereby the redistribution of charge between loads on the display section side can be done efficiently.

In one embodiment, the sub-pixels include groups of sub-pixels for different colors to be displayed; and the voltage supply line connected to the odd-numbered signal line and the voltage supply line connected to the even-numbered signal line supply the image-forming signals for driving the sub-pixels of the same color. In this way, the sub-pixels of the same color are shorted with each other, whereby the redistribution of charge between loads on the display section side can be done even more efficiently than when simply shorting adjacent signal lines with each other.

In one embodiment, the signal lines include three groups of signal lines for red, green and blue; and the $K^{th}$ signal line and the $(K+3)^{th}$ signal line are electrically shorted with each other by the shorting means, where K is any natural number. In this way, the redistribution of charge between loads on the display section side can be done effectively in a case where the display device is an RGB full-color display device.

In one embodiment, voltage supply lines that are for supplying the image-forming signals to the sub-pixels of the same color are all electrically shorted together during the predetermined period. In this way, the potentials of the voltage supply lines shorted together are better averaged, whereby the redistribution of charge between loads on the display section side can be done efficiently.

In one embodiment, the shorting means includes: a shorting line for electrically connecting the voltage supply line connected to the odd-numbered signal line to the voltage supply line connected to the even-numbered signal line during the predetermined period; a switching element provided along the shorting line and including a control section; and a control element for performing a control so that either the potential of the voltage supply line connected to the odd-numbered signal line or the potential of the voltage supply line connected to the even-numbered signal line is applied to the control section at least during the predetermined period. In this way, the connection means can be turned OFF in response to the switching between the polarity of the potential of the voltage supply line connected to the odd-numbered signal line and the polarity of the potential of the voltage supply line connected to the even-numbered signal line.

In one embodiment, the switching element is a first MISFET of a first conductivity type, with the control section being a gate electrode of the switching element; and the control element includes a second MISFET of a second conductivity type provided between the voltage supply line connected to the odd-numbered signal line and the gate electrode of the switching element, and a third MISFET of the second conductivity type provided between the voltage supply line connected to the even-numbered signal line and the gate electrode of the switching element. In this way, for example, the redistribution of charge between loads on the display section side can be done without wasting the charge not only during a period in which the switches in the display device driving circuit are OFF but also when the switches are OFF, whereby the power consumption of the display device can be reduced even if the load on the display side is large. Moreover, since MISFETs are used for the connection means, it is possible to reduce the circuit area, and thus the chip size.

In one embodiment, a polarity of each of the image-forming signals is inverted for every horizontal scanning period; and a control is performed so that either the potential of the voltage supply line connected to the odd-numbered signal line or the potential of the voltage supply line connected to the even-numbered signal line is applied to the control section of the switching element throughout the horizontal scanning period. In this way, the power consumption of the display device can be reduced even if the load on the display side is large, as described above.

In one embodiment, the control element farther includes a fourth MISFET of the first conductivity type provided between a ground and a gate electrode of the first MISFET for turning OFF the switching element except during the predetermined period; and a line connecting the fourth MISFET to the gate electrode of the first MISFET is connected to the second MISFET and the third MISFET. In this way, for example, even if the rising or falling of an image-forming signal input to the voltage supply line is slow relative to the transition of the potential of the signal line, the charge stored in the load on the display side can be prevented from leaking toward the switch as the fourth MISFET turns OFF the switching element, and the second and third MISFETs are turned OFF. Moreover, the display device driving circuit can be driven with an image-forming signal whose timing is the same as that of an image-forming signal used in a conventional display device driving circuit, whereby the power consumption can be reduced without replacing the peripheral devices such as the controller.

In one embodiment, the shorting means includes: a first shorting line and a second shorting line for electrically connecting the voltage supply line connected to the odd-numbered signal line to the voltage supply line connected to the even-numbered signal line during the predetermined period; a first switching element provided along the first shorting line, wherein the first switching element is turned ON only when the potential of the voltage supply line connected to the odd-numbered signal line is equal to or greater than the potential of the voltage supply line connected to the even-numbered signal line, and is turned OFF autonomously when the potential of the voltage supply line connected to the odd-numbered signal line is less than the potential of the voltage supply line connected to the even-numbered signal line; and a second switching element provided along the second shorting line, wherein the second switching element is turned ON only when the potential of the voltage supply line connected to the even-numbered signal line is equal to or greater than the potential of the voltage supply line connected to the odd-numbered signal line, and is turned OFF autonomously when the potential of the voltage supply line connected to the even-numbered signal line is less than the potential of the voltage supply line connected to the odd-numbered signal line. In this way, the connection means can be kept ON during a period in which it is desirable to redistribute the charge between loads on the display section side, while the connection means can be turned OFF in response to the switching between the polarity of the potential of the voltage supply line connected to the odd-numbered signal line and the polarity of the potential of the voltage supply line connected to the even-numbered signal line. Thus, the charge stored in the load on the display section side can be efficiently redistributed, thereby reducing the power consumption.

In one embodiment, the first switching element includes an MISFET of a first conductivity type whose gate electrode is connected to the first shorting line, and a first transfer gate; and the second switching element includes an MISFET of the first conductivity type whose gate electrode is connected to the second shorting line, and a second transfer gate. In this way, the connection means can be kept OFF, irrespective of the potentials of the voltage supply lines, by turning OFF the first transfer gate and the second transfer gate for a predetermined period of time. Alternatively, the first transfer gate or the second transfer gate may be turned ON, so that the first shorting line or the second shorting line is kept ON until the polarities of the potentials of the voltage supply lines connected to an odd-numbered signal line and an even-numbered signal line are switched around. As a result, the circuit designing process can be simplified.

Moreover, similar effects can be obtained also when the first switching element includes a first diode and a third transfer gate; and the second switching element includes a fourth transfer gate and a second diode, wherein the first diode and the second diode are arranged in opposite directions to each other with respect to a first output section and a second output section.

In one embodiment, connecting portions of the voltage supply lines for connecting the voltage supply lines to the plurality of signal lines are provided in a plurality of wiring layers; and the connecting portions are provided so that those that are connected to adjacent ones of the plurality of signal lines, or those that are connected to ones of the plurality of signal lines of the same color, are adjacent to each other in the same wiring layer. In this way, the potential difference between adjacent connecting portions in the same wiring layer can be made larger than that in the prior art, whereby the product inspection process, e.g., the detection of defective products, can be facilitated. Thus, it is possible to improve the reliability of a display device driving circuit for realizing a display device with a reduced power consumption.

In one embodiment, connecting portions of the voltage supply lines for connecting the voltage supply lines to the plurality of signal lines are provided in a plurality of wiring layers; and among the connecting portions, those that are connected to adjacent ones of the plurality of signal lines, or those that are connected to ones of the plurality of signal lines of the same color, are separately provided in a first one of the plurality of wiring layers and in a second one of the plurality of wiring layers, the second wiring layer being immediately above the first wiring layer, and are arranged so as to overlap with each other as viewed from above. In this way, the potential difference between connecting portions that are arranged one on top of the other via an interlayer insulating film therebetween can be made larger than that in the prior art, whereby the product inspection process, e.g., the detection of defective products, can be facilitated.

In one embodiment, the display device driving circuit further includes a plurality of operational amplifiers arranged in a row for transferring the image-forming signals to the switches; and one of the plurality of operational amplifiers that is for outputting the image-forming signal to be supplied to the $K^{th}$ signal line is adjacent to another one of the plurality of operational amplifiers that is for outputting the image-forming signal to be supplied to the $(K+3)^{th}$ signal line. In this way, in a case where voltage supply lines for supplying image-forming signals of the same color are shorted with each other, it is possible to reduce the wire routing, etc., and thus to simplify the circuit designing process. Moreover, the circuit area can also be reduced.

In one embodiment, a polarity of the image-forming signals to be supplied to the odd-numbered signal line is opposite to that of the image-forming signals to be supplied to the even-numbered signal line. In this way, voltage supply lines for supplying image-forming signals of different polarities are shorted with each other, whereby the redistribution of charge between loads on the display section side can be done efficiently.

A second display device driving circuit of the present invention is a display device driving circuit for use with a display device having a display section including sub-pixels arranged in a matrix pattern and a plurality of signal lines for supplying image-forming signals to the sub-pixels, the display device driving circuit including: voltage supply lines for transferring the image-forming signals to the plurality of signal lines; switches for turning ON/OFF the transfer of the image-forming signals to the voltage supply lines; a plurality of operational amplifiers arranged in a row for transferring the image-forming signals to the switches; and shorting means for electrically shorting one of the voltage supply lines that is connected to an odd-numbered one of the plurality of signal lines with another one of the voltage supply lines that is connected to an even-numbered one of the plurality of signal lines during a predetermined period including a period during which the switches are OFF, wherein one of the operational amplifiers that is for outputting the image-forming signal to be supplied to the $K^{th}$ signal line is adjacent to another one of the operational amplifiers that is for outputting the image-forming signal to be supplied to the $(K+3)^{th}$ signal line, where K is a natural number. In this way, in a case where the display device is a full-color display device using three basic colors, sub-pixels of the same color, which are likely to have similar gray scales, are shorted with each other, whereby the redistribution of charge between loads on the display section side can be done even more efficiently than when simply shorting adjacent signal lines with each other.

In one embodiment, voltage supply lines that are for supplying the image-forming signals to the sub-pixels of the same color are all electrically shorted together during the predetermined period. In this way, the redistribution of charge between loads on the display section side can be done even more efficiently.

A display device of the present invention includes: a display section, the display section including sub-pixels arranged in a matrix pattern, a plurality of signal lines for supplying image-forming signals to the sub-pixels, and shorting means for electrically shorting a first, odd-numbered one of the plurality of signal lines with a second, even-numbered one of the plurality of signal lines during a predetermined period, wherein the shorting means can be turned OFF autonomously when a potential of a voltage supply line connected to the odd-numbered signal line and a potential of a voltage supply line connected to the even-numbered signal line are switched around; and a display device driving circuit provided along a frame portion of the display section and including a first voltage supply line connected to the first signal line and a second voltage supply line connected to the second signal line.

With such a configuration, the driving circuit can be controlled so that the connection means is turned OFF autonomously when the polarity of the potential of the odd-numbered signal line and the polarity of the potential of the even-numbered signal line are switched around, whereby the connection means can be kept ON until the distribution of charge between a load on the display section side including the odd-numbered signal line and a load on the display section side including the even-numbered signal line is completed. As a result, it is possible to reduce the amount of current flowing from the display device driving circuit to the display section.

In one embodiment, the sub-pixels include groups of sub-pixels for different colors to be displayed; and the first signal line and the second signal line are signal lines for supplying the image-forming signals to the sub-pixels of the same color. In this way, sub-pixels of the same color, which are likely to have similar gray scales, are shorted with each other, whereby the power consumption is even more reduced than when simply shorting adjacent signal lines with each other.

In one embodiment, signal lines that are for supplying the image-forming signals to the sub-pixels of the same color are all electrically shorted together. In this way, the power consumption can be reduced more effectively.

In one embodiment, the shorting means includes: a shorting line for electrically connecting the odd-numbered signal line to the even-numbered signal line during the predetermined period; a switching element provided along the shorting line and including a control section; and a control element for performing a control so that either the potential of the voltage supply line connected to the odd-numbered signal line or the potential of the voltage supply line connected to the even-numbered signal line is applied to the control section at least during the predetermined period. In this way, the switching element can be turned OFF autonomously in response to the switching between the polarity of the potential of the voltage supply line connected to the odd-numbered signal line and the polarity of the potential of the voltage supply line connected to the even-numbered signal line.

In one embodiment, the shorting means includes: a first shorting line and a second shorting line for electrically connecting the odd-numbered signal line to the even-numbered signal line during the predetermined period; a first switching element provided along the first shorting line, wherein the first switching element is turned ON only when the potential of the voltage supply line connected to the odd-numbered signal line is equal to or greater than the potential of the voltage supply line connected to the even-numbered signal line, and is turned OFF autonomously when the potential of the voltage supply line connected to the odd-numbered signal line is less than the potential of the voltage supply line connected to the even-numbered signal line; and a second switching element provided along the second shorting line, wherein the second switching element is turned ON only when the potential of the voltage supply line connected to the even-numbered signal line is equal to or greater than the potential of the voltage supply line connected to the odd-numbered signal line, and is turned OFF autonomously when the potential of the voltage supply line connected to the even-numbered signal line is less than the potential of the voltage supply line connected to the odd-numbered signal line. In this way, the connection means can be kept ON during a period in which it is desirable to redistribute the charge between loads on the display section side, while the connection means can be turned OFF in response to the switching between the polarity of the potential of the voltage supply line connected to the odd-numbered signal line and the polarity of the potential of the voltage supply line connected to the even-numbered signal line. Thus, the charge stored in the load on the display section side can be efficiently redistributed, thereby reducing the power consumption.

DESCRIPTION OF THE PREFERRED EMBODIMENTS

First Embodiment

A liquid crystal display device according to the first embodiment of the present invention is characterized by the means for shorting output sections of a signal line driving circuit (display device driving circuit) with each other.

Figure 1:
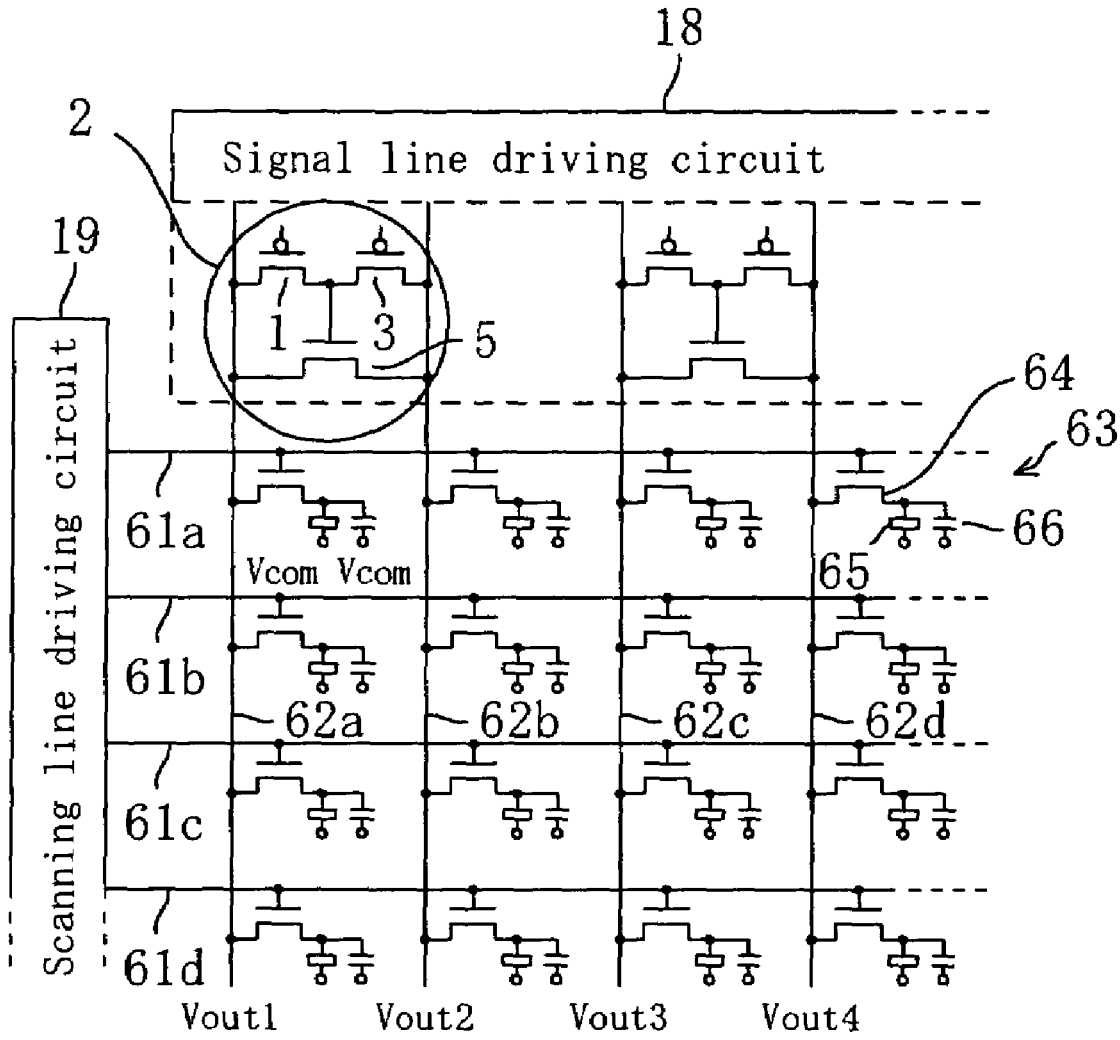
FIG. 1 is a circuit diagram illustrating a liquid crystal display device according to a first embodiment of the present invention.

FIG. 1 is a circuit diagram illustrating a liquid crystal display device used in a dot inversion driving mode according to the first embodiment of the present invention.

As illustrated in FIG. 1, the liquid crystal display device of the present embodiment includes a signal line driving circuit 18 provided along the upper or lower side of the bezel portion, a scanning line driving circuit 19 provided along the left or right side of the bezel portion, and a display section (liquid crystal panel).

The display section whose configuration is similar to that of the conventional example includes a plurality of signal lines 62*a*, 62*b*, 62*c*, . . . , (hereinafter referred to collectively as "signal lines 62") extending in the column direction (the vertical direction in the figure) from the signal line (source) driving circuit 18, a plurality of scanning lines (gate lines) 61*a*, 61*b*, 61*c*, . . . , (hereinafter referred to collectively as "scanning lines 61") extending in the row direction (the horizontal direction in the figure) from the scanning line (gate line) driving circuit 19, and sub-pixels 63 arranged in a matrix pattern. Each sub-pixel 63 is located near one of a plurality of intersections between the signal lines 62 and the scanning lines 61. Moreover, each sub-pixel 63 includes a liquid crystal cell 65, a hold condenser 66 and a TFT 64. The liquid crystal material in the liquid crystal cell 65 is interposed between a pixel electrode and a counter electrode.

The signal line driving circuit 18 is normally a multiple-output integrated circuit, and supplies output voltages Vout1, Vout2, Vout3, . . . , to the source electrodes of the TFTs 64. Herein, the output voltages Vout1, Vout2, Vout3, . . . , are used for driving sub-pixels of R, G, B, . . . , respectively. The signal line driving circuit 18 is provided only along the upper or lower side of the bezel portion of the liquid crystal display device in FIG. 1, it may be divided into two parts that are provided respectively along the upper and lower sides of the bezel portion. In such a case, in the signal line driving circuit 18 provided along the upper side, an output section for supplying a signal to an even-numbered signal line 62 and an output section for applying a signal to an odd-numbered signal line 62 are provided so as to be adjacent to each other. Similarly, in the signal line driving circuit 18 provided along the lower side, an output section for supplying a signal to an even-numbered signal line 62 and an output section for applying a signal to an odd-numbered signal line 62 are provided so as to be adjacent to each other.

Moreover, also the scanning line driving circuit 19 is normally a multiple-output integrated circuit, and supplies output voltages to the gate electrodes of the TFTs 64.

Note that although shorting means 2, including a first control transistor 1, a second control transistor 3 and a shorting transistor 5, is shown in FIG. 1 to be outside the signal line driving circuit 18, it is actually provided inside the signal line driving circuit 18. The shorting means 2 is for electrically shorting adjacent output sections of the signal line driving circuit 18 with each other. In the present embodiment, for example, an R level output section is shorted with a G level output section, and a B level output section is shorted with an R level output section. Alternatively, output sections of the same color may be shorted with each other. This will be described in detail in subsequent embodiments.

Next, the signal line driving circuit 18 (hereinafter referred to as "the signal line driving circuit of the present embodiment"), which is a characteristic feature of the present embodiment, will be described.

Figure 2:
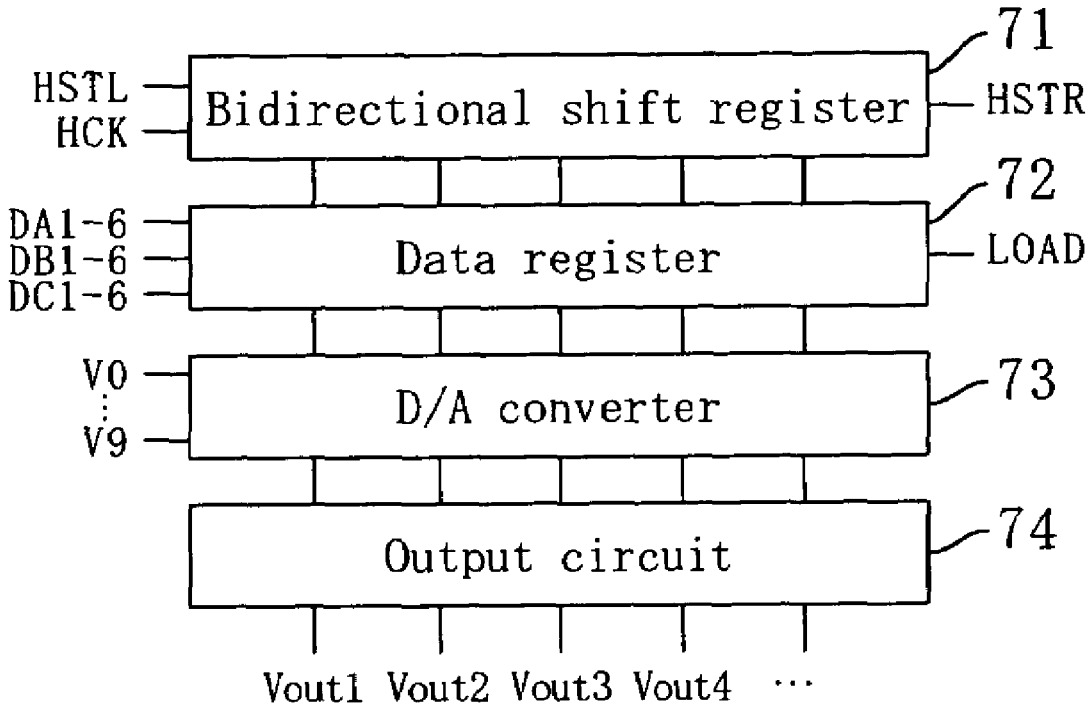
FIG. 2 is a block diagram schematically illustrating a configuration of a signal line driving circuit of the present invention.

FIG. 2 is a block diagram schematically illustrating a configuration of the signal line driving circuit of the present embodiment.

As illustrated in FIG. 2, the signal line driving circuit of the present embodiment includes a bidirectional shift register 71, a data register 72, a D/A converter 73 and an output circuit 74, which are connected together in this order. Note that although not shown in the figure, the data register 72 includes a first-stage latch and a second-stage latch.

In the signal line driving circuit, the bidirectional shift register 71 receives a start pulse HSTR (or HSTL) to generate, in synchronization with a horizontal clock HCK, a shift pulse for successively transferring data. The first-stage latch in the data register 72 receives the shift pulse to latch digital data DA1-6, DB1-6 and DC1-6 for outputting signal voltages for different sub-pixels. Then, as the data register 72 receives a data load signal LOAD, the digital data DA1-6, DB1-6 and DC1-6 are transferred to the second-stage latch and, at the same time, output to the D/A converter 73. The D/A converter 73 converts the digital signal held in the data register 72 into an analog signal. Then, image-forming signals obtained by the digital-to-analog conversion are output from the output circuit 74.

Note that the characteristic feature of the signal line driving circuit of the present embodiment lies inside the output circuit 74, and thus the signal line driving circuit may take any alternative configuration other than that illustrated in FIG. 2.

Figure 3:
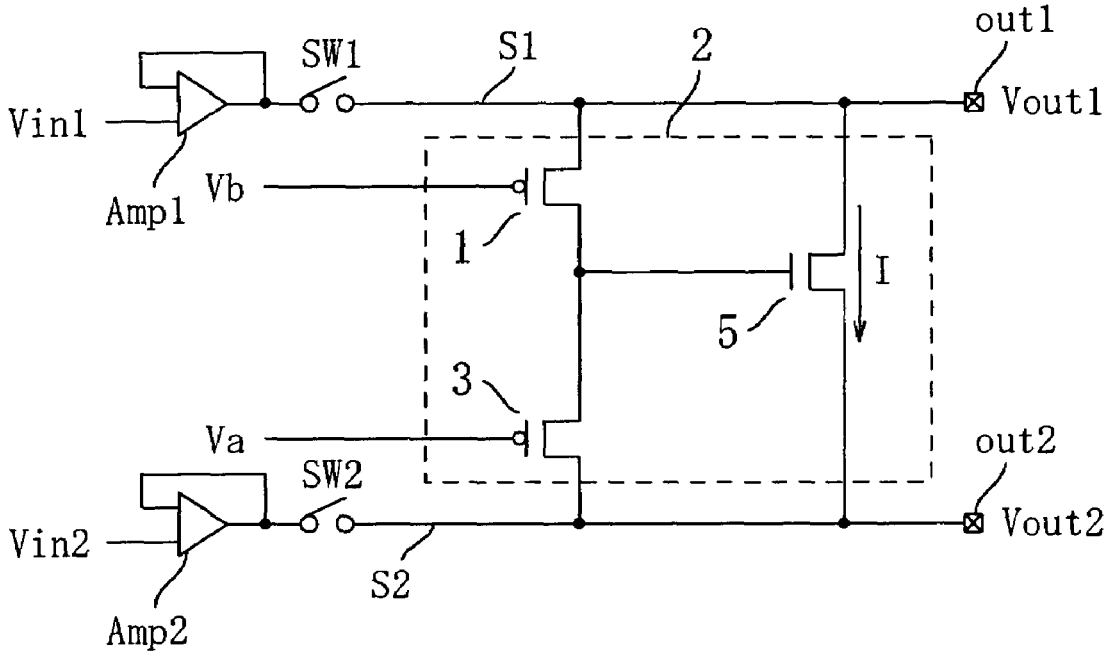
FIG. 3 is a circuit diagram illustrating a configuration of an output circuit in the signal line driving circuit according to the first embodiment.

FIG. 3 is a circuit diagram illustrating the configuration of the output circuit in the signal line driving circuit of the present embodiment.

As illustrated in FIG. 3, the signal line driving circuit of the present embodiment includes operational amplifiers Amp1 and Amp2 whose outputs are fed back to their inputs, output sections out1 and out2 for supplying the output voltages Vout1 and Vout2, respectively, to the liquid crystal panel, a voltage supply line S1 connecting the output section of the operational amplifier Amp1 to the output section out1, a voltage supply line S2 connecting the output section of the operational amplifier Amp2 to the output section out2, a switch SW1 provided along the voltage supply line S1, a switch SW2 provided along the voltage supply line S2, and the shorting means 2 provided between the voltage supply line S1 and the voltage supply line S2 for shorting the output section out1 with the output section out2. Herein, the term "output section" refers to a portion of a voltage supply line that is connected to the signal line 62 of the display section.

The shorting means 2 is provided between a portion of the voltage supply line S1 (a portion between the switch SW1 and the output section out1) and a portion of the voltage supply line S2 (a portion between the switch SW2 and the output section out2), and has a different configuration from that of the conventional shorting means.

Specifically, the shorting means 2 includes the first control transistor 1, the second control transistor 3 and the shorting transistor 5. The first control transistor 1 and the second control transistor 3 are provided along a line extending between the voltage supply line S1 and the voltage supply line S2. The shorting transistor 5 is provided along a shorting line extending between the voltage supply line S1 and the voltage supply line S2, and the gate electrode of the shorting transistor 5 is connected between the first control transistor 1 and the second control transistor 3. Herein, the first control transistor 1 and the second control transistor 3 are P-channel MISFETs controlled by control signals Vb and Va, respectively, and the shorting transistor 5 is an N-channel MISFET. Note that a current flows through the shorting line along which the shorting transistor 5 is provided when output sections are shorted with each other, as will be described later.

Next, the operation of the output circuit will be described.

Figure 4:
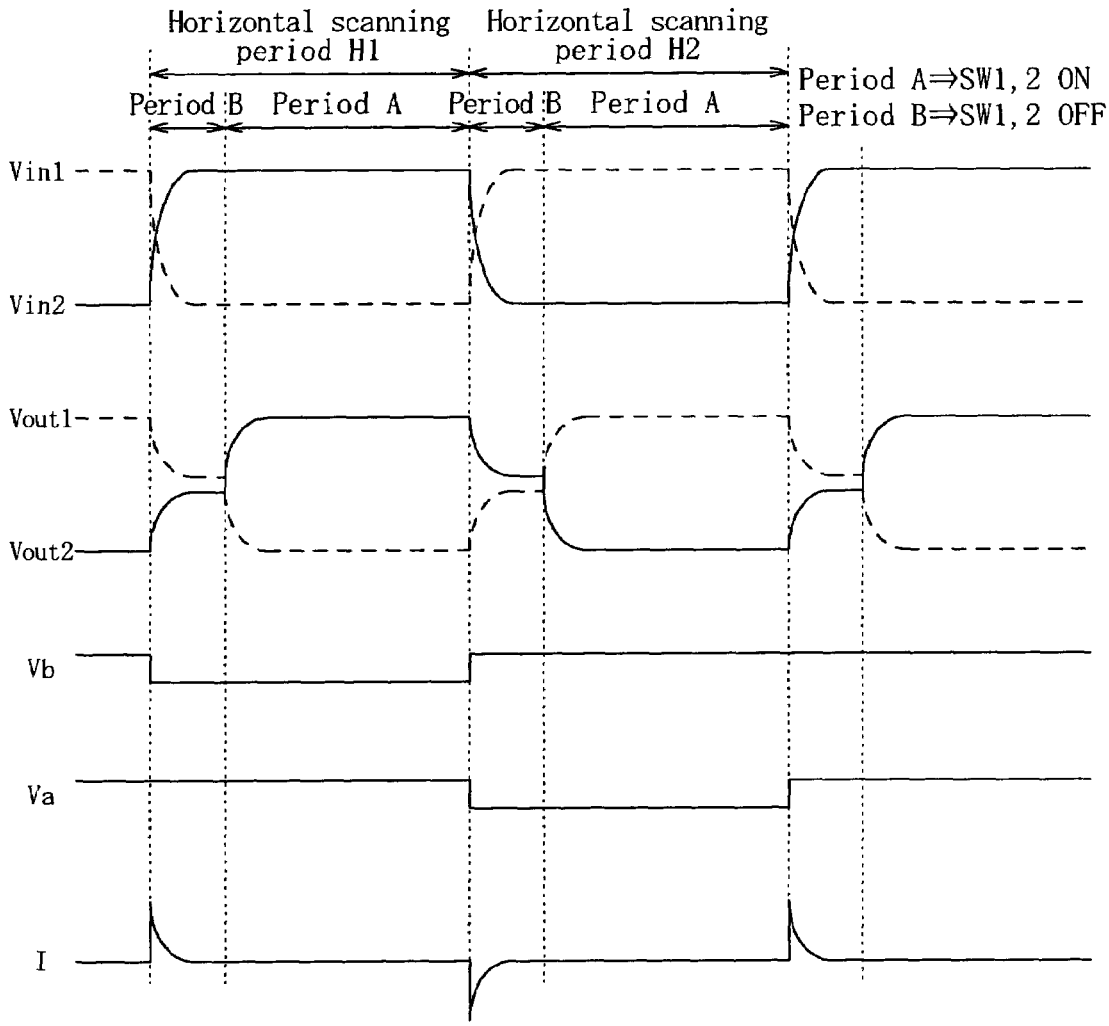
FIG. 4 is a timing chart illustrating voltage transitions at various points in the output circuit and transitions of a current flowing through a shorting line, in the signal line driving circuit according to the first embodiment.

FIG. 4 is a timing chart illustrating voltage transitions at various points in the output circuit and transitions of the current flowing through the shorting line, in the signal line driving circuit of the present embodiment. Note that the output waveforms from the operational amplifiers Amp1 and Amp2 are the same as the input waveforms thereto.

As the signal line driving circuit of the present embodiment is used in a dot inversion driving mode, the polarity of the input voltage to each of the operational amplifiers Amp1 and Amp2 is inverted for every horizontal scanning period. Moreover, the voltages Vout1 and Vout2 of the adjacent output sections out1 and out2 are voltages of opposite polarities with respect to a common voltage Vcom (not shown).

First, as illustrated in FIG. 4, during the period B (the high impedance period of the operational amplifiers Amp1 and Amp2) in the horizontal scanning period H1, the polarities of input voltages Vin1 and Vin2 to the operational amplifiers Amp1 and Amp2 transition from (+) and (−) to (−) and (+), respectively. In this period B, the switches SW1 and SW2 are both turned OFF.

The control voltage Vb is at the low level (low voltage), and the control voltage Va is at the high level (high voltage). Thus, in the period B, the first control transistor 1 is ON, and the second control transistor 3 is OFF.

At the start of the period B, the polarity of Vout1 is (+) and the polarity of Vout2 is (−), whereby Vout1 of a high voltage is input to the gate electrode of the shorting transistor 5, thus turning ON the shorting transistor 5. Therefore, the current I flows from a panel-side load connected to the output section out1 to a panel-side load connected to the output section out2 via the shorting transistor 5.

Note that in the signal line driving circuit of the present embodiment, the shorting transistor 5 is ON while Vth<(Vout1−Vout2) is satisfied in a case where Vout1>Vout2, and the shorting transistor 5 is ON while Vth<(Vout2−Vout1) is satisfied in a case where Vout1<Vout2. Herein, Vth is the threshold voltage of the shorting transistor 5 with respect to the substrate potential.

Thus, the shorting transistor 5 will not be turned OFF at least until completion of the distribution of the charge stored in the load.

With the operation as described above, the potential of the output section out1 can be brought closer to that of the output section out2 without consuming power. Note that at this time, it is regarded that the potential of the voltage supply line S1 is equal to that of the output section out1, and the potential of the voltage supply line S2 is equal to that of the output section out2.

Next, during the period A in the horizontal scanning period H1, the switches SW1 and SW2 are both turned ON, and the outputs of the operational amplifiers Amp1 and Amp2 are transferred to the output sections out1 and out2, respectively. At this time, the load connected to the output section out1 discharges a current flowing from the output section out1 to the operational amplifier Amp1, and the load connected to the output section out2 is charged with the current flowing from the operational amplifier Amp2 to the output section out2.

Moreover, in the period A, as in the period B, the control voltage Vb is at the low level, and the control voltage Va is at the high level, whereby the gate electrode of the shorting transistor 5 remains connected to the output section out. Therefore, the shorting transistor 5 is turned OFF autonomously when the potential difference between Vout1 and Vout2 becomes less than Vth immediately after the start of the period A, as illustrated in FIG. 4.

Next, during the horizontal scanning period H2 following the horizontal scanning period H1, the polarities of Vout1 and Vout2, the polarities of Vin1 and Vin2, etc., are opposite to those during the horizontal scanning period H1.

In the period B, the switches SW1 and SW2 are both turned OFF, and the shorting transistor 5 is turned ON as the gate electrode thereof is connected to the output section out2. Then, the current I flows from the output section out2 to the output section out1 via the shorting transistor 5.

Then, in the period A, the switches SW1 and SW2 are turned ON, and the shorting transistor 5 is turned OFF when the potential difference between Vout1 and Vout2 becomes less than Vth.

Thereafter, the horizontal scanning period H1 and H2 are repeated.

As described above, with the signal line driving circuit of the present embodiment, the charge stored in a panel-side load can be distributed to an adjacent load without wasting the charge, whereby the power consumption can be reduced.

The power conversing function of the signal line driving circuit of the present embodiment is particularly pronounced when the panel-side load capacitance is large.

When the panel-side load capacitance is large, charge distribution between loads may not be completed within the period B of the horizontal scanning period H1, for example. With the signal line driving circuit of the present embodiment, even in the period A, the shorting transistor 5 remains ON until the polarities of Vout1 and Vout2 are switched around, whereby the charge distribution between loads is continued. Thus, only a small amount of charge is required from the output of the operational amplifier Amp2.

In contrast, in the conventional signal line driving circuit, the shorting transfer gate is turned OFF at the end of the period B. Typically, one horizontal scanning period is about 10 μsec, and the period B thereof is as short as about 40 to 50 nsec, and it is difficult to completely redistribute the charge stored in panel-side loads within such a short period of time.

The power consumption reducing effect as described above can be obtained similarly in the horizontal scanning period H2.

As described above, with the signal line driving circuit of the present embodiment, the power consumption can be reduced effectively even if the panel capacitance is larger than those in the prior art. Thus, with the signal line driving circuit of the present embodiment, it is possible to realize a large-screen liquid crystal display device in which the power consumption is suppressed.

Moreover, the amount of current flowing through the operational amplifiers Amp1 and Amp2 can be reduced, whereby heat generation in the signal line driving circuit can be suppressed, and the circuit is less likely to malfunction due to heat.

Furthermore, in the signal line driving circuit of the present embodiment, it is only required, for the purpose of power conservation, to reduce the ON resistance of the shorting transistor 5, whereby the first control transistor 1 and the second control transistor 3 can be made in their minimum size. Therefore, the circuit area can also be reduced as compared with the conventional signal line driving circuit.

Note that in the signal line driving circuit of the present embodiment, it is preferred that the operational amplifiers Amp1 and Amp2 have a sufficiently high response speed so that the charge of a panel side load can be redistributed without wasting the charge.

Note that referring to FIG. 3, the point at which the line connected to the first control transistor 1 diverges from the voltage supply line S1 and the point at which the line connected to the second control transistor 3 diverges from the voltage supply line S2 may be provided closer to the output sections than the points at which the line connected to the shorting transistor 5 diverges from the voltage supply lines S1 and S2, respectively.

Note that in the above description of the signal line driving circuit of the present embodiment, the first control transistor 1 and the second control transistor 3 are P-channel MISFETs while the shorting transistor 5 is an N-channel MISFET. However, similar effects can be obtained when the control transistors are both N-channel MISFETs while the shorting transistor 5 is a P-channel MISFET.

Moreover, the first control transistor 1, the second control transistor 3 and the shorting transistor 5 may be bipolar transistors.

Note that in the signal line driving circuit of the present embodiment, the shorting means 2 may be provided between every pair of adjacent voltage supply lines, or may only be provided between a particular pair or particular pairs of voltage supply lines.

Moreover, the application of the signal line driving circuit of the present embodiment is not limited to liquid crystal display devices, but the signal line driving circuit of the present embodiment can be used in any suitable display device in which a charge is stored in a panel-side load, e.g., an EL (ElectroLuminescence) display device. This is true also with the subsequent embodiments.

Note that while the shorting means for shorting output sections with each other is provided within the signal line driving circuit in the present embodiment, it may alternatively be provided within the liquid crystal panel. In such a case, the transistors forming the shorting means may be provided in a sub-pixel on the same substrate on which TFTs are formed, and may be made of polysilicon or amorphous silicon. This also is true with the subsequent embodiments.

Moreover, the signal line driving circuit may be provided to the user in the form of a semiconductor chip, a TCP or a COF (Chip On Film).

Note that the MISFETs used in the signal line driving circuit of the present invention are most preferably MOSFETs as they are easy to manufacture.

Second Embodiment

The second embodiment of the present invention will now be described below. The second embodiment of the present invention is directed to a signal line driving circuit including shorting means of the same configuration as that of the first embodiment, wherein output sections of the same color are shorted with each other by the shorting means.

Note that the configuration of the signal line driving circuit other than the output circuit, and the configuration of the liquid crystal panel to be driven by the signal line driving circuit are similar to those of the first embodiment.

Figure 5:
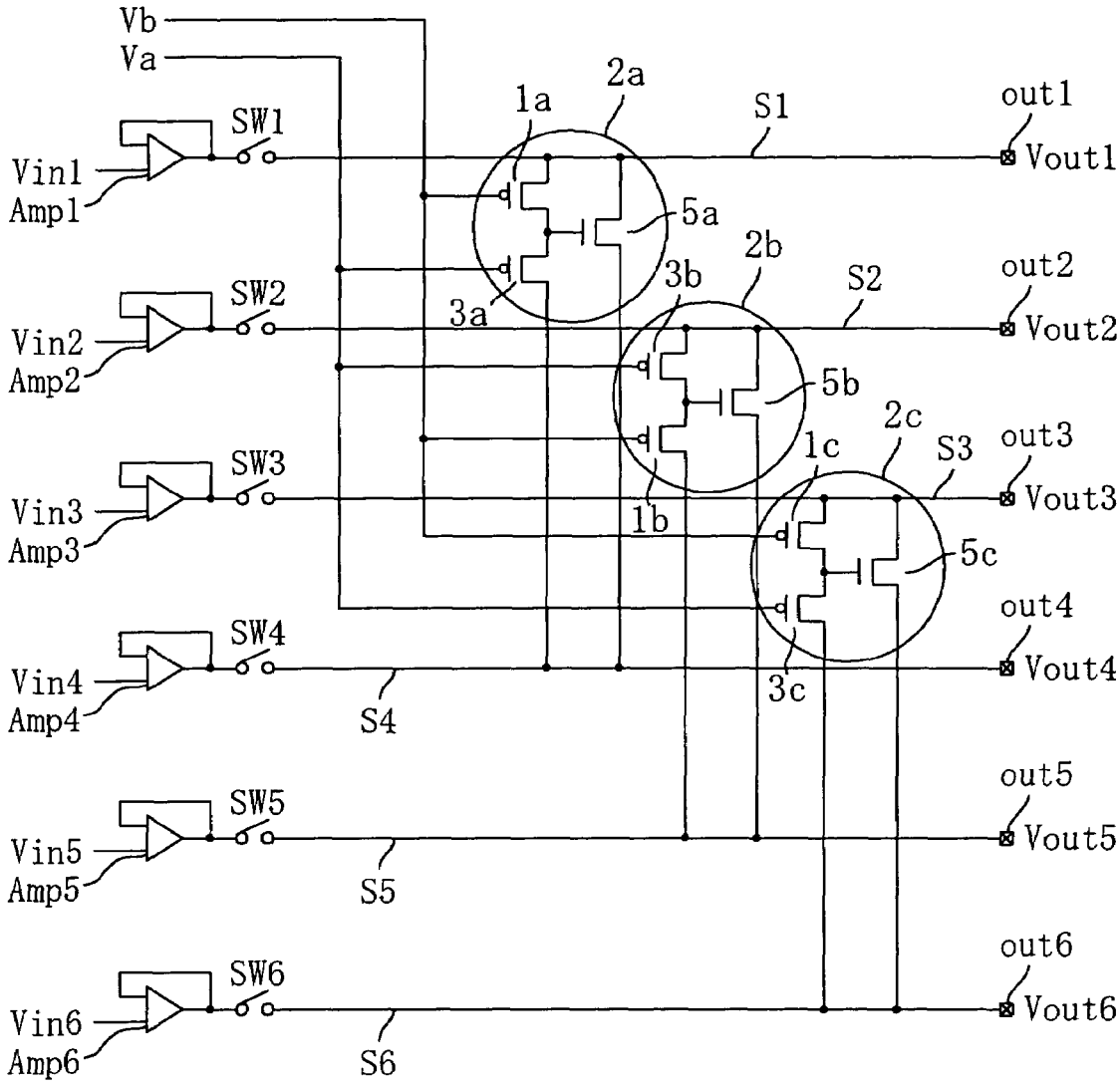
FIG. 5 is a circuit diagram illustrating a configuration of an output circuit in a signal line driving circuit according to a second embodiment of the present invention.

FIG. 5 is a circuit diagram illustrating the configuration of the output circuit in the signal line driving circuit of the present embodiment.

As illustrated in FIG. 5, the signal line driving circuit of the present embodiment includes operational amplifiers Amp1, Amp2, . . . , $Amp_N$ (where N is the number of outputs per signal line driving circuit on one chip) whose outputs are fed back to their inputs, output sections out1, out2, . . . , $out_N$ for supplying output voltages Vout1, Vout2, . . . , $Vout_N$, respectively, to the liquid crystal panel, a voltage supply line $S_K$ connecting the output section of the $K^{th}$ (where $1 \leqq K+3 \leqq N$; K is a natural number) operational amplifier $Amp_K$ to the output section $out_K$, a switch $SW_K$ provided along the voltage supply line $S_K$, and shorting means 2*a*, 2*b*, . . . , (hereinafter referred to collectively as "shorting means 2") provided between the voltage supply line $S_K$ and the voltage supply line $S_{K+3}$ for shorting the output section $out_K$ with the output section $out_{K+3}$. The number N of outputs per signal line driving circuit provided on one chip is 384 or 480, for example.

Moreover, since the signal line driving circuit of the present embodiment is for use with a full-color liquid crystal display device, the N output sections connected to the N voltage supply lines are arranged in the circuit in a predetermined order of color, e.g., R-G-B-R-G-B. Note that in the signal line driving circuit of the present embodiment, when the shorting means is turned ON, the voltage supply lines S1 and S4, and S7 and S10, are electrically shorted with each other. Alternatively, the voltage supply lines S4 and S7 may be further shorted with each other, or voltage supply lines that are connected to the output sections of the same color may all be shorted together. Alternatively, each set of a predetermined number of voltage supply lines may be shorted together.

Each shorting means 2 includes the same components as that of the first embodiment.

Specifically, the shorting means 2 includes the first control transistor 1, the second control transistor 3 and the shorting transistor 5. The first control transistor 1 and the second control transistor 3 are provided along a line extending between the $K^{th}$ voltage supply line $S_K$ and the $(K+3)^{th}$ voltage supply line $S_{K+3}$. The shorting transistor 5 is provided along a shorting line extending between the voltage supply line $S_K$ and the voltage supply line $S_{K+3}$, and the gate electrode of the shorting transistor 5 is connected between the first control transistor 1 and the second control transistor 3. Herein, the first control transistor 1 and the second control transistor 3 are P-channel MISFETs controlled by the control signals Vb and Va, respectively, and the shorting transistor 5 is an N-channel MISFET.

Note that the term "first control transistor 1" represents one of a plurality of first control transistors 1*a*, 1*b*, . . . , illustrated in FIG. 5, "second control transistor 3" represents one of a plurality of second control transistors 3*a*, 3*b*, . . . , and "shorting transistor 5" represents one of a plurality of shorting transistors 5*a*, 5*b*, . . . .

Moreover, in the present embodiment, the same control signal Vb is input to the gate electrodes of the first control transistors 1, and the same control signal Va is input to the gate electrode of the second control transistors 3.

Note that the operation of the output circuit in the signal line driving circuit of the present embodiment is basically the same as that of the signal line driving circuit of the first embodiment illustrated in FIG. 4.

Note however that in the signal line driving circuit of the present embodiment, output sections of the same color are shorted with each other. Accordingly, exchanging "Vin1" for "$Vin_K$" (an input signal to the $K^{th}$ voltage supply line), "Vin2" for "$Vin_{K+3}$", "Vout1" for "$Vout_K$" and "Vout2" for "$Vout_{K+3}$" in FIG. 4 describes the operation of present embodiment.

As described above, in the signal line driving circuit of the present embodiment, output sections of the same color are all shorted together at a predetermined time, whereby the charge stored in the panel-side loads can be distributed more efficiently than in the first embodiment.

This is because in a liquid crystal panel, sub-pixels of the same color are more likely to have similar gray scales than sub-pixels of different colors.

For example, when a solid red display is rendered on a 64-gray-scale liquid crystal display device, the R level is 64 while the G and B levels are both 0. In such a case, when an R output section and a G output section are shorted with each other as in the first embodiment, the amount of charge stored in the R load is greater than the amount of charge stored in the G load, whereby the panel-side loads cannot be redistributed effectively.

In contrast, with the signal line driving circuit of the present embodiment, R output sections (or G or B output sections) are shorted with each other, whereby charge is exchanged between loads at the same gray scale, and the charge is redistributed efficiently. Therefore, with the signal line driving circuit of the present embodiment, it is possible to realize a liquid crystal display device with a reduced power consumption as compared with a conventional signal line driving circuit. While the operation has been described while using a solid red display as an example, for the sake of simplicity, similar power conserving effects can be obtained in a normal display because adjacent sub-pixels of the same color are likely to have similar gray scales.

Moreover, while an output section of a color is shorted with the nearest output section of the same color in the example illustrated in FIG. 5, more than two output sections of the same color may be electrically shorted with each other, or all output sections of the same color may be shorted together. When all of the output sections of the same color are electrically shorted together, the potentials of the output sections are better averaged and brought closer to the middle potential (common voltage), whereby charge can be redistributed more reliably.

Note that MISFETs, which can be integrated easily, are used for the shorting means of the present embodiment, and the first control transistor 1 and the second control transistor 3 can be made in their minimum size as in the first embodiment, whereby the circuit area can be reduced as compared with the conventional signal line driving circuit.

Note that the first control transistor 1 and the second control transistor 3 may both be N-channel MISFETs, and the shorting transistor 5 may be a P-channel MISFET.

Moreover, the first control transistor 1, the second control transistor 3 and the shorting transistor 5 may be bipolar transistors.

Note that the configuration of the present embodiment where output sections of the same color are shorted with each other provides a power conserving effect by itself. Therefore, it can be used effectively even in a case where the shorting means is simply a transfer gate as in the conventional circuit.

Note that an actual circuit layout for realizing the circuit configuration illustrated in FIG. 5 will be described later in subsequent embodiments. In the present embodiment, the circuit is shown so that a pair of adjacent output sections of the same color interpose output sections of other colors therebetween. However, in an actual circuit layout, output sections of the same colors may be arranged with no output sections of other colors therebetween. Note however that the signal lines on the panel side are normally arranged in the order of color, e.g., R-G-B-R . . . .

Third Embodiment

A signal line driving circuit according to the third embodiment of the present invention is obtained by partially modifying the configuration of the shorting means of the first embodiment.

Figure 6:
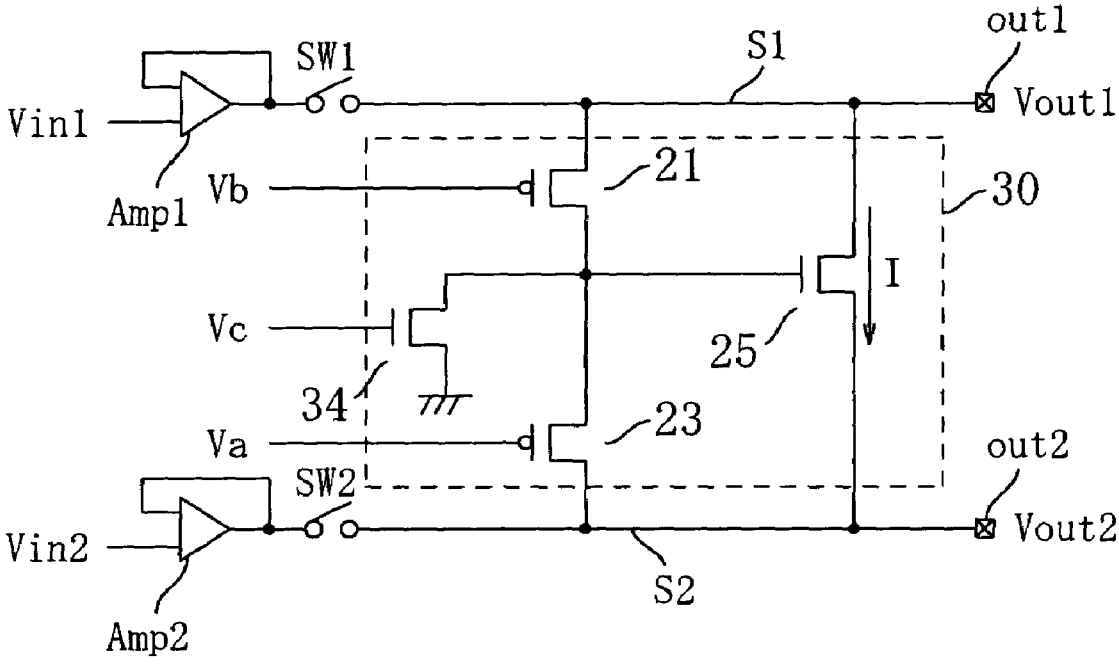
FIG. 6 is a circuit diagram illustrating a configuration of an output circuit in a signal line driving circuit according to a third embodiment of the present invention.

FIG. 6 is a circuit diagram illustrating the configuration of the output circuit in the signal line driving circuit of the present embodiment.

As illustrated in FIG. 6, the signal line driving circuit of the present embodiment includes operational amplifiers Amp1 and Amp2 whose outputs are fed back to their inputs, output sections out1 and out2 for supplying the output voltages Vout1 and Vout2, respectively, to the liquid crystal panel, a voltage supply line S1 connecting the output section of the operational amplifier Amp1 to the output section out1, a voltage supply line S2 connecting the output section of the operational amplifier Amp2 to the output section out2, a switch SW1 provided along the voltage supply line S1, a switch SW2 provided along the voltage supply line S2, and shorting means 30 provided between the voltage supply line S1 and the voltage supply line S2 for shorting the output section out1 with the output section out2. The shorting means 30 is provided between a portion of the voltage supply line S1 (a portion between the switch SW1 and the output section out1) and a portion of the voltage supply line S2 (a portion between the switch SW2 and the output section out2).

The shorting means 30 includes a first control transistor 21, a second control transistor 23, a shorting transistor 25 and a third control transistor 34. The first control transistor 21 and the second control transistor 23 are provided along a line extending between the voltage supply line S1 and the voltage supply line S2. The shorting transistor 25 is provided along a line extending between the voltage supply line S1 and the voltage supply line S2, and the gate electrode thereof is connected to a line extending between the first control transistor 21 and the second control transistor 23. The third control transistor 34 is controlled by a control signal Vc, and is provided between the ground and the gate electrode of the shorting transistor 25. Herein, the first control transistor 21 and the second control transistor 23 are P-channel MISFETs controlled by control signals Vb and Va, respectively, and the shorting transistor 25 is an N-channel MISFET. Moreover, the third control transistor 34 is an N-channel MISFET, and the line connecting the third control transistor 34 to the gate electrode of the shorting transistor 25 is connected to the line connecting the first control transistor 21 to the second control transistor 23.

Note that while only two voltage supply lines S1 and S2 and two output sections are shown in FIG. 6, one signal line driving circuit actually includes multiple (e.g., 512) voltage supply lines and multiple output sections. Moreover, in the circuit diagram, the output sections are arranged in a predetermined order, e.g., R-G-B-R-G-B . . . . Actual layout of the lines and the output sections will be described in subsequent embodiments.

As described above, the signal line driving circuit of the present embodiment differs from the first embodiment in that the third control transistor 34 for controlling the shorting transistor 25 is further provided.

Next, the effect of the provision of the third control transistor 34 will be described in connection with the operation of the output circuit.

Figure 7:
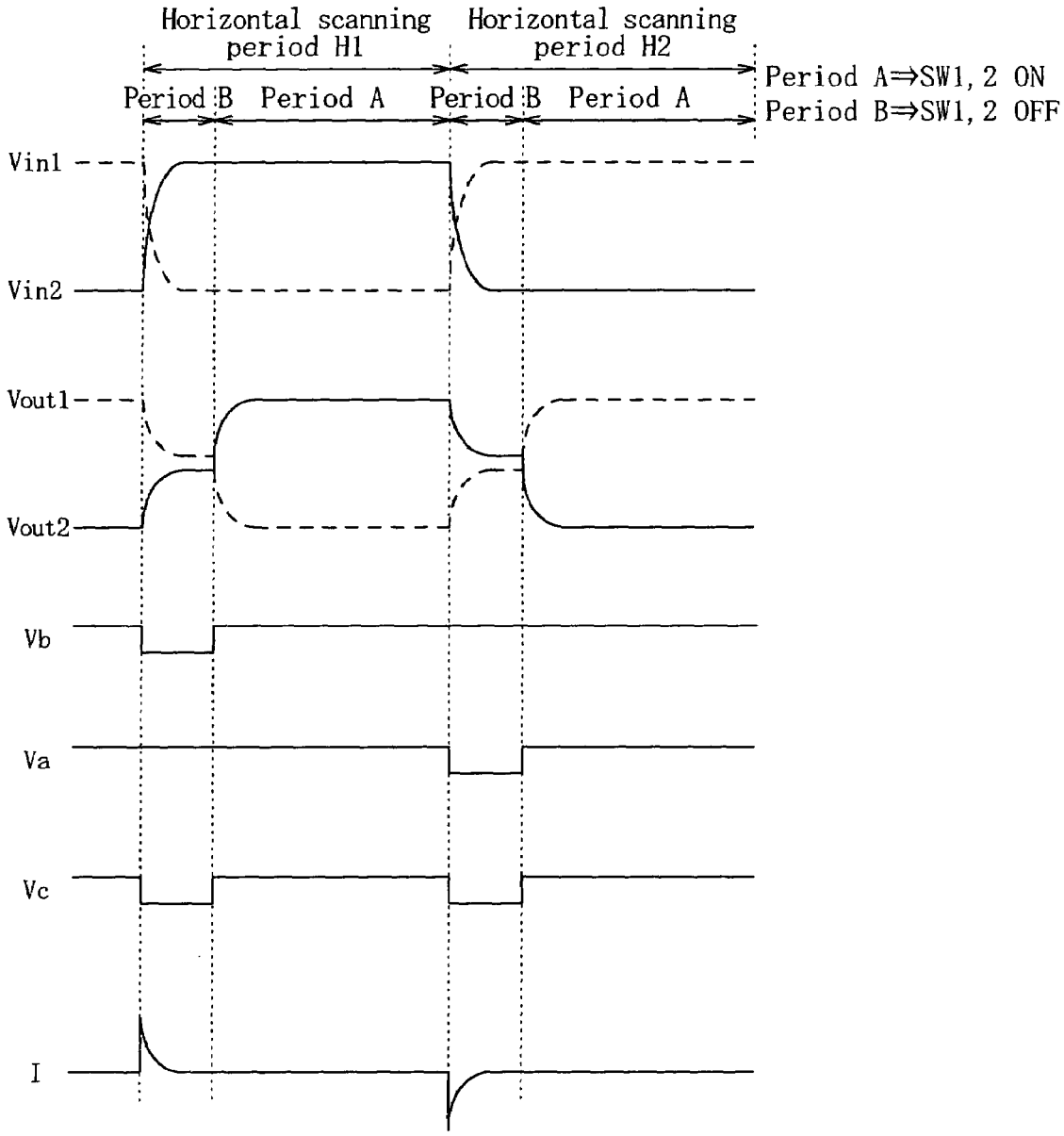
FIG. 7 is a timing chart illustrating voltage transitions at various points in the output circuit and transitions of a current flowing through a shorting line, in the signal line driving circuit according to the third embodiment.

FIG. 7 is a timing chart illustrating voltage transitions at various points in the output circuit and transitions of the current flowing through the shorting line, in the signal line driving circuit of the present embodiment.

First, as illustrated in FIG. 7, during the period B in the horizontal scanning period H1, the polarities of input voltages Vin1 and Vin2 to the operational amplifiers Amp1 and Amp2 transition from (+) and (−) to (−) and (+), respectively. In this period B, the switches SW1 and SW2 are both turned OFF.

In this period, the control voltage Vb is at the low level, the control voltage Va is at the high level, and the control voltage Vc is at the low level. Therefore, in the period B, the first control transistor 21 is ON, the second control transistor 23 is OFF, and the third control transistor 34 is OFF.

At the start of the period B, a high voltage Vout1 is input to the gate electrode of the shorting transistor 25, thereby turning ON the shorting transistor 25. Therefore, the current I flows from a panel-side load connected to the output section out1 to a panel-side load connected to the output section out2 via the shorting transistor 25.

Note that also in the signal line driving circuit of the present embodiment, the shorting transistor 25 is ON when the threshold voltage Vth of the shorting transistor 25 is less than the difference between Vout1 and Vout2. Therefore, in the period B, the shorting transistor 25 will not be turned OFF until completion of the distribution of the charge stored in the load. Up to this point, the operation is similar to that of the first embodiment.

Next, during the period A in the horizontal scanning period H1, the switches SW1 and SW2 are both turned ON, and the outputs of the operational amplifiers Amp1 and Amp2 are transferred to the output sections out1 and out2, respectively. At this time, the load connected to the output section out1 discharges a current flowing from the output section out1 to the operational amplifier Amp1, and the load connected to the output section out2 is charged with the current flowing from the operational amplifier Amp2 to the output section out2.

Moreover, in the period A, the control voltages Vb and Vc transition to the high level, and the control voltage Va remains at the high level. Therefore, the first control transistor 21 and the second control transistor 23 are OFF, and the third control transistor 34 is ON, thereby grounding the gate electrode of the shorting transistor 25. As a result, the shorting transistor 25 is turned OFF quickly.

Then, in the following horizontal scanning period, an operation as described above is repeated with the polarities of the voltages of the output sections out1 and out2 being reversed from those during the horizontal scanning period H1.

As described above, a feature of the operation of the signal line driving circuit of the present embodiment is in that the shorting transistor 25 is turned OFF quickly in the period A illustrated in FIG. 7.

When the operational amplifiers Amp1 and Amp2 are slow, or when the output load is under particular conditions, the charge redistributed to panel-side loads via the shorting transistor 25 may be drawn by the operational amplifiers Amp1 and Amp2. For example, where the voltage transitions of the outputs from the operational amplifiers Amp1 and Amp2 are slower than the transitions of the voltages Vout1 and Vout2 of the output sections, and the output voltage of the operational amplifier Amp2 is still lower than Vout2 at the start of the period A in the horizontal scanning period H1, the current I is drawn by the operational amplifier Amp2 if the shorting transistor 25 is still ON. Moreover, the output load is determined by the resistance of the operational amplifiers and the lines of the output circuit, and the current passing through the shorting means may flow into the operational amplifiers depending on the value of k.

However, with the signal line driving circuit of the present embodiment, the shorting transistor 25 is turned OFF quickly in the period A, the charge of the panel-side loads can be redistributed reliably without losing the charge.

As described above, with the signal line driving circuit of the present embodiment, it is not necessary to optimize the output load, whereby the circuit designing process can be simplified. Moreover, the effect of reducing the power consumption is less likely to be influenced by the response speed of the operational amplifiers.

In addition, since only MISFETs, which can be integrated easily, are used for the shorting means 30, the circuit area can be made smaller.

Moreover, since the signal line driving circuit of the present embodiment is compatible with a controller (a device for producing the cycle of a signal) used in a conventional liquid crystal display device, it is possible to reduce the power consumption without modifying the external circuit.

Fourth Embodiment

The fourth embodiment of the present invention will now be described below. The fourth embodiment of the present invention is directed to a signal line driving circuit including shorting means of the same configuration as that of the third embodiment, wherein output sections of the same color are shorted with each other by the shorting means.

Note that the configuration of the signal line driving circuit other than the output circuit, and the configuration of the liquid crystal panel to be driven by the signal line driving circuit are similar to those of the first to third embodiments.

Figure 8:
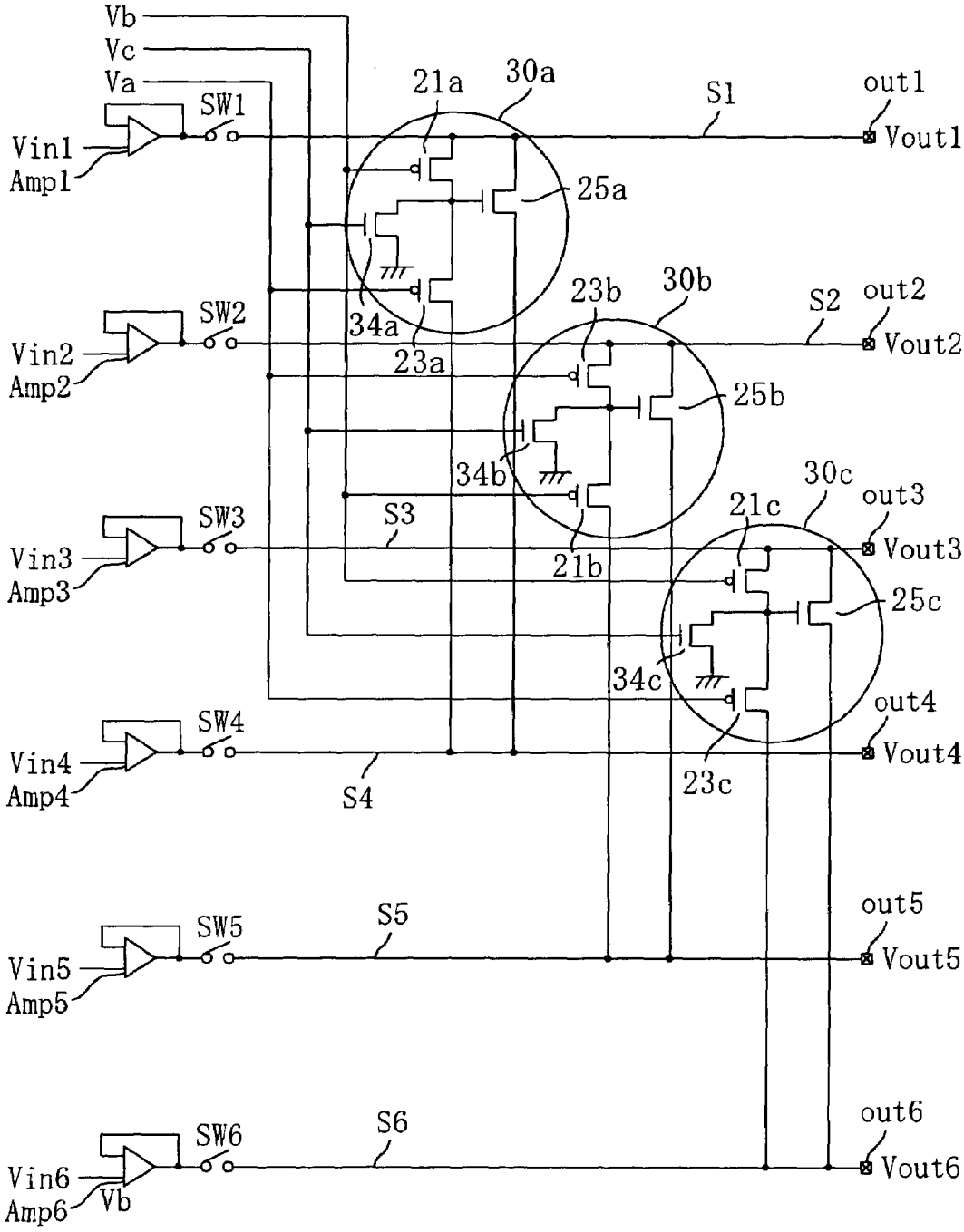
FIG. 8 is a circuit diagram illustrating a configuration of an output circuit in a signal line driving circuit according to a fourth embodiment of the present invention.

FIG. 8 is a circuit diagram illustrating the configuration of the output circuit in the signal line driving circuit of the present embodiment.

As illustrated in FIG. 8, the signal line driving circuit of the present embodiment includes operational-amplifiers Amp1, Amp2, . . . , $Amp_N$ (where N is the number of outputs per signal line driving circuit on one chip) whose outputs are fed back to their inputs, output sections out1, out2, . . . , $out_N$ for supplying output voltages Vout1, Vout2, . . . , $Vout_N$, respectively, to the liquid crystal panel, a voltage supply line $S_K$ connecting the output section of the $K^{th}$ (where $1 \leqq K+3 \leqq N$; K is a natural number) operational amplifier $Amp_K$ to the output section $out_K$, a switch $SW_K$ provided along the voltage supply line $S_K$, and shorting means 30*a*, 30*b*, . . . , (hereinafter referred to collectively as "shorting means 30") provided between the voltage supply line $S_K$ and the voltage supply line $S_{K+3}$ for shorting the output section $out_K$ with the output section $out_{K+3}$. The number N of outputs per signal line driving circuit provided on one chip is 384 or 480, for example.

Moreover, since the signal line driving circuit of the present embodiment is for use with a full-color liquid crystal display device, the N output sections connected to the N voltage supply lines are arranged in the circuit in a predetermined order of color, e.g., R-G-B-R-G-B. Note that in the signal line driving circuit of the present embodiment, when the shorting means is turned ON, the voltage supply lines S1 and S4, and S7 and S10, are electrically shorted with each other. Alternatively, the voltage supply lines S4 and S7 may be further shorted with each other, or voltage supply lines that are connected to the output sections of the same color may all be electrically shorted together. Note that the number of output sections to be shorted together may be any suitable number equal to or greater than 2.

The shorting means 30 includes the first control transistor 21, the second control transistor 23, the shorting transistor 25 and the third control transistor 34. The first control transistor 21 and the second control transistor 23 are provided along a first line extending between the $K^{th}$ voltage supply line $S_K$ and the $(K+3)^{th}$ voltage supply line $S_{K+3}$. The shorting transistor 25 is provided along a shorting line extending between the voltage supply line $S_K$ and the voltage supply line $S_{K+3}$, and the gate electrode thereof is connected between the first control transistor 21 and the second control transistor 23. The third control transistor 34 is connected to a line between the first control transistor 21 and the second control transistor 23 and is provided between the gate electrode of the shorting transistor 25 and the ground. Herein, the first control transistor 21 and the second control transistor 23 are P-channel MISFETs controlled by the control signals Vb and Va, respectively, and the third control transistor 34 is an N-channel MISFET controlled by the control signal Vc. Moreover, the shorting transistor 25 is an N-channel MISFET.

Note that the operation of the output circuit in the signal line driving circuit of the present embodiment is basically the same as that of the signal line driving circuit of the first embodiment illustrated in FIG. 7.

Note however that in the signal line driving circuit of the present embodiment, output sections of the same color are shorted with each other. Accordingly, exchanging "Vin1" for "$Vin_K$" (an input signal to the $K^{th}$ voltage supply line), "Vin2" for "$Vin_{K+3}$", "Vout1" for "$Vout_K$" and "Vout2" for "$Vout_{K+3}$" in FIG. 7 describes the operation of the present embodiment.

As described above, in the signal line driving circuit of the present embodiment, output sections of the same color are all shorted together at a predetermined time, whereby the charge stored in the panel-side loads can be distributed more efficiently than with the signal line driving circuit of the third embodiment.

Thus, with the signal line driving circuit of the present embodiment, it is possible to realize a large liquid crystal television or a large liquid crystal display for personal computers, with a reduced power consumption.

Fifth Embodiment

A signal line driving circuit according to the fifth embodiment of the present invention is characterized by the provision of two shorting lines through which a current flows when output sections are shorted with each other.

Figure 9:
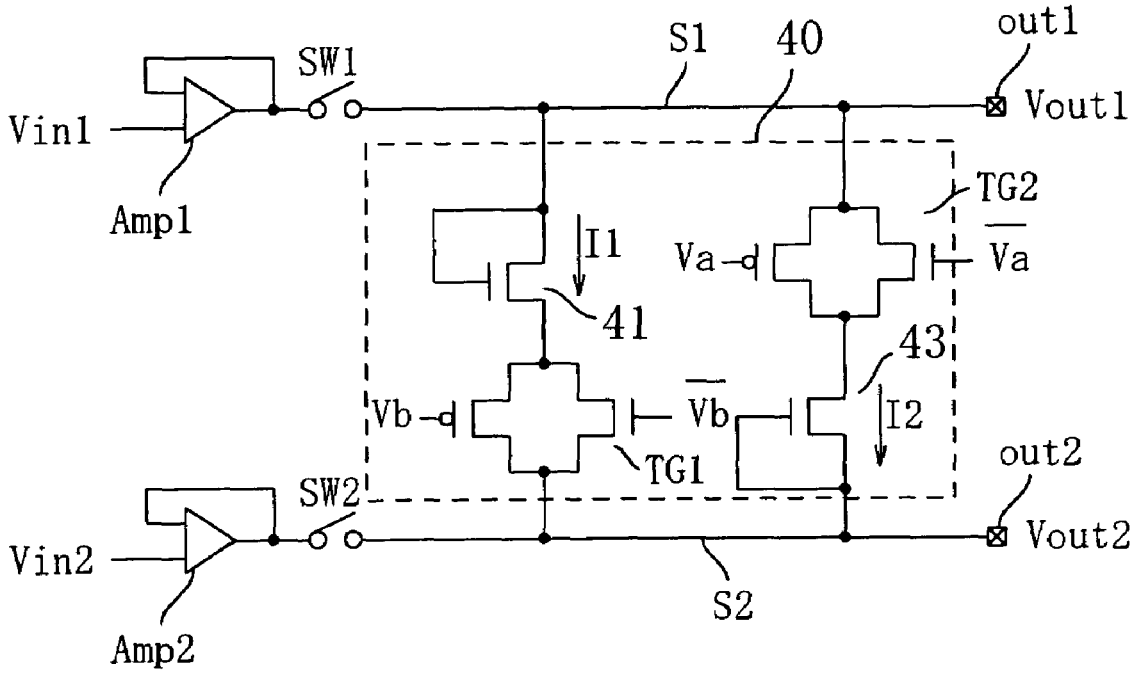
FIG. 9 is a circuit diagram illustrating a configuration of an output circuit in a signal line driving circuit according to a fifth embodiment of the present invention.

FIG. 9 is a circuit diagram illustrating the configuration of the output circuit in the signal line driving circuit of the present embodiment.

As illustrated in FIG. 9, the configuration of the signal line driving circuit of the present embodiment is the same as that of the first or third embodiment except for shorting means 40. Therefore, only the shorting means 40 will be described below.

The shorting means 40 connects the voltage supply line S1 to the voltage supply line S2, and includes a first shorting line and a second shorting line, through which a current passes when the output section out1 and the output section out2 are shorted with each other, and elements provided along the shorting lines.

A first shorting transistor 41 and a first transfer gate TG1 having a CMOS structure are provided along the first shorting line, with the first shorting transistor 41 being located closer to the voltage supply line S1, and a second transfer gate TG2 having a CMOS structure and a second shorting transistor 43 are provided along the second shorting line, with the second transfer gate TG2 being located closer to the voltage supply line S1.

Moreover, the first shorting transistor 41 and the second shorting transistor 43 are both N-channel MISFETs. The gate electrode of the first shorting transistor 41 is connected along the first shorting line between the first shorting transistor 41 and the voltage supply line S1, and the gate electrode of the second shorting transistor 43 is connected along the second shorting line between the second shorting transistor 43 and the voltage supply line S2.

The P-channel MISFET of the first transfer gate TG1 is controlled by the control signal Vb, and the N-channel MISFET thereof is controlled by a phase-inverted version of the control signal Vb. Moreover, the P-channel MISFET of the second transfer gate TG2 is controlled by the control signal Va, and the N-channel MISFET thereof is controlled by a phase-inverted version of the control signal Va.

Note that while only two voltage supply lines S1 and S2 and two output sections are shown in FIG. 9, one signal line driving circuit actually includes multiple (e.g., 512) voltage supply lines and multiple output sections. Moreover, in the circuit diagram, the voltage supply lines and the output sections are arranged in a predetermined order, e.g., R-G-B-R-G-B . . . . Actual layout of the lines and the output sections will be described in subsequent embodiments.

As described above, the signal line driving circuit of the present embodiment differs from those of the first and third embodiments in that two separate shorting lines are provided respectively for different directions of the current flow.

Next, the effect of the provision of two separate shorting lines will be described in connection with the operation of the output circuit.

Figure 10:
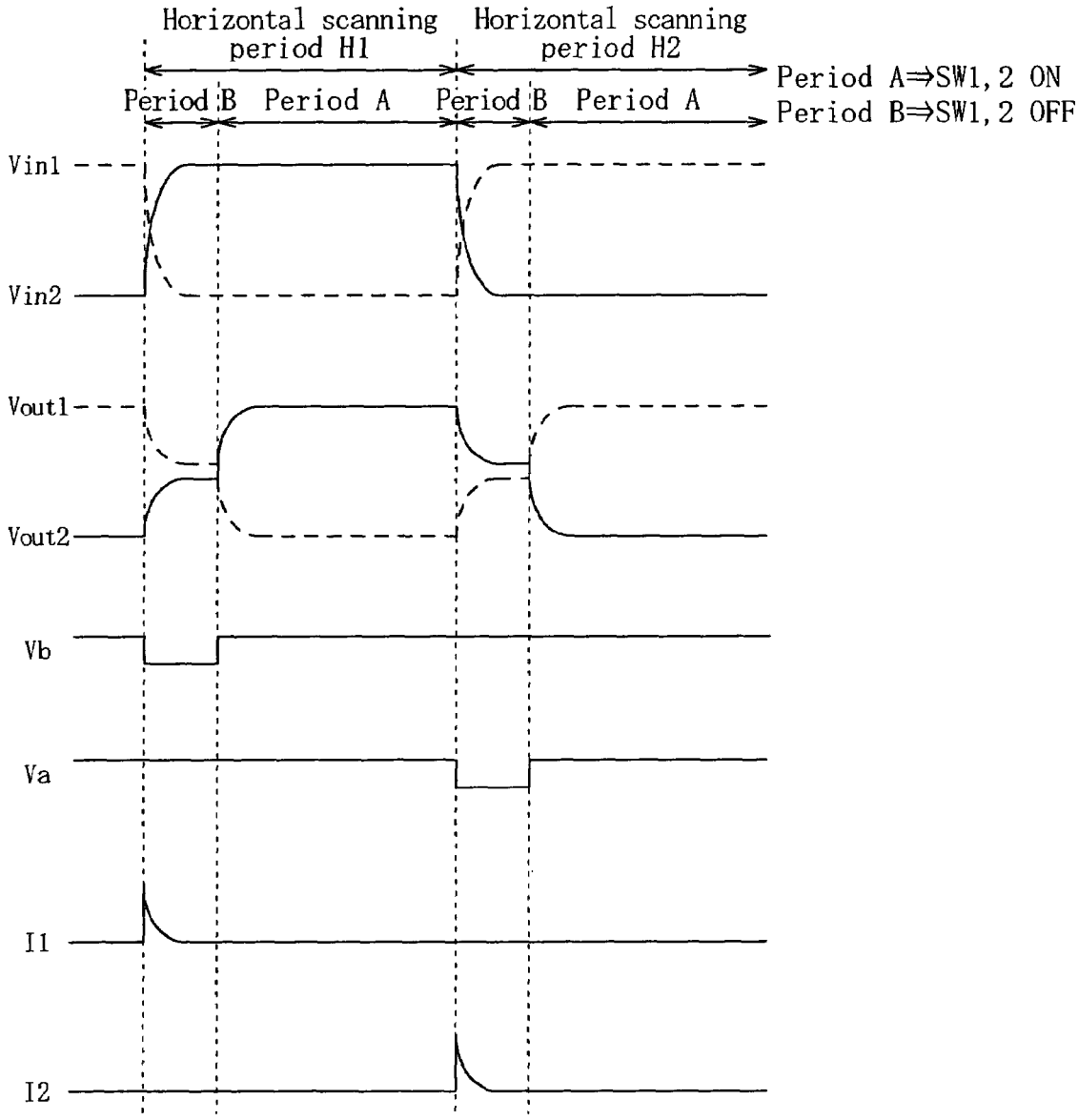
FIG. 10 is a timing chart illustrating voltage transitions at various points in the output circuit and transitions of currents flowing through shorting lines, in the signal line driving circuit according to the fifth embodiment.

FIG. 10 is a timing chart illustrating voltage transitions at various points in the output circuit and transitions of currents flowing through shorting lines, in the signal line driving circuit of the present embodiment.

First, as illustrated in FIG. 7, during the period B in the horizontal scanning period H1, the polarities of input voltages Vin1 and Vin2 to the operational amplifiers Amp1 and Amp2 transition from (+) and (−) to (−) and (+), respectively. In this period B, the switches SW1 and SW2 are both turned OFF.

In this period, the control voltage Vb is at the low level and the control voltage Va is at the high level. Therefore, in the period B, the first transfer gate TG1 is ON and the second transfer gate TG2 is OFF.

Therefore, the impurity diffusion regions (source/drain regions) of the first shorting transistor 41 are electrically connected respectively to the output sections out1 and out2. Thus, in the period B, the first shorting transistor 41 is controlled by the voltage Vout1 of the output section out1, and is thus turned ON. Then, a current I1 flows from a panel-side load connected to the output section out1 to a panel-side load connected to the output section out2 via the first shorting transistor 41.

On the other hand, while the gate electrode of the second shorting transistor 43 and one impurity diffusion region are electrically connected to the output section out2, the other impurity diffusion region is not electrically connected to the output section out1. Therefore, in the period B, the second shorting transistor 43 is OFF.

Next, during the period A in the horizontal scanning period H1, the switches SW1 and SW2 are both turned ON, and the outputs of the operational amplifiers Amp1 and Amp2 are transferred to the output sections out1 and out2, respectively. At this time, the panel-side load connected to the output section out1 discharges a current flowing from the output section out1 to the operational amplifier Amp1, and the panel-side load connected to the output section out2 is charged with the output from the operational amplifier Amp2.

Moreover, in the period A, the control voltage Vb transitions to the high level, and the control voltage Va remains at the high level. Therefore, the first transfer gate TG1 and the second transfer gate TG2 are both OFF. Thus, no current flows through the first shorting line or through the second shorting line.

Therefore, even if the response speed of the operational amplifier Amp1 is low, for example, the current I1 flowing through the first shorting line can be prevented from flowing toward the operational amplifier Amp1. Thus, the charge stored in the panel-side loads can be redistributed without losing the charge.

Then, in the horizontal scanning period H2, the polarities of Vin1, Vin2, Vout1 and Vout2 are reversed from those during the horizontal scanning period H1, and the circuit operation is reversed accordingly.

Specifically, in the period B, the first transfer gate TG1 and the first shorting transistor 41 are both OFF while the second transfer gate TG2 and the second shorting transistor 43 are both ON. As a result, a current I2 flows through the second shorting line, and a current flows from a panel-side load connected to the output section out2 to a panel-side load connected to the output section out1.

Then, in the period A, the panel-side load connected to the output section out1 is charged with the output of the operational amplifier Amp1, and a current flows from the panel-side load connected to the output section out2 toward the operational amplifier Amp2.

At this point, the first transfer gate TG1 and the first shorting transistor 41 are both OFF, and the second transfer gate TG2 and the second shorting transistor 43 are also both OFF.

As described above, with the signal line driving circuit of the present embodiment, the charge can be redistributed between adjacent panel-side loads during the period B. Moreover, the charge redistribution can be done efficiently, irrespective of the response speed of the operational amplifiers Amp1 and Amp2 and the output load of the circuit, whereby the circuit designing process can be simplified.

Moreover, when the response speed of the operational amplifiers Amp1 and Amp2 is sufficiently high, or when the output load of the circuit is appropriate, the collection of charge from the panel-side load can be continued, with the control signal Vb being left at the low level during the period A in the horizontal scanning period H1, and with the control signal Va being left at the low level during the period A in the horizontal scanning period H2. In such a case, in the horizontal scanning period H1, for example, the first shorting transistor 41 is turned OFF automatically when relationship between the potential of the output section out1 and that of the output section out2 is reversed, whereby the charge stored in the panel-side loads can be utilized without losing the charge. This is true also in the horizontal scanning period H2. Thus, the amount of current to be supplemented from the signal line driving circuit can be reduced.

With the signal line driving circuit of the present embodiment, it is possible to reduce the power consumption even if, for example, the load capacitance of the liquid crystal display device is large, by employing a driving method as described above.

Note that while two shorting lines are provided between the voltage supply lines S1 and S2 in the signal line driving circuit of the present embodiment, three or more shorting lines may alternatively be provided.

Moreover, while the gate electrode of the first shorting transistor 41 is connected to a point closer to the voltage supply line S1 in the signal line driving circuit illustrated in FIG. 9, similar effects can be obtained even if it is connected to another point that is closer to the first transfer gate TG1. Similarly, the gate electrode of the second shorting transistor 43 may alternatively be connected to a point along the second shorting line that is closer to the second transfer gate TG2.

Moreover, the same effect can be obtained even if the positions of the first transfer gate TG1 and the first shorting transistor 41, along the first shorting line, are switched around. Similarly, the positions of the second shorting transistor 43 and the second transfer gate TG2 may be switched around.

Moreover, the first shorting transistor 41 and the second shorting transistor 43 used in the signal line driving circuit of the present embodiment may be replaced with devices having diode characteristics.

Figure 11:
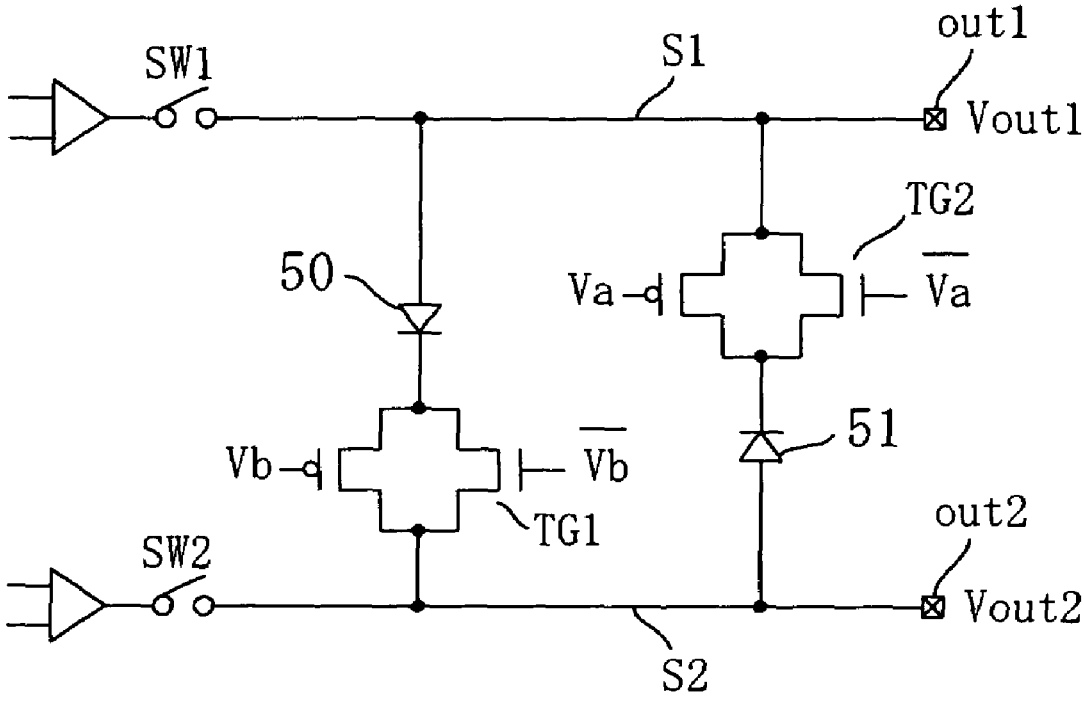
FIG. 11 is a circuit diagram illustrating another signal line driving circuit according to the fifth embodiment where diodes are used instead of shorting transistors.

FIG. 11 is a circuit diagram illustrating another signal line driving circuit of the present embodiment where diodes are used instead of shorting transistors. A power conserving effect similar to that when MISFETs are used can be obtained even if a diode (first diode 50) whose output section is connected to the first transfer gate TG1 is used instead of the first shorting transistor 41, while a diode (second diode 51) whose output section is connected to the second transfer gate TG2 is used instead of the second shorting transistor 43, as illustrated in FIG. 11. In such a case, the first diode 50 and the second diode 51 are arranged in opposite directions to each other with respect to the output sections out1 and out2.

Moreover, the first shorting transistor 41 and the second shorting transistor 43 may alternatively be replaced with bipolar transistors.

Note that while adjacent output sections of different colors (e.g., R and G or B and R) are connected to each other by the shorting means in the present embodiment, the power consumption can be reduced even more effectively by connecting two or more output sections of the same color to each other as in the second and fourth embodiments. Actual layout of the circuit and the lines will be described in subsequent embodiments.

Sixth Embodiment

The sixth embodiment of the present invention will now be described below. The sixth embodiment of the present invention is directed to a wiring structure for the output circuits of the signal line driving circuits according to the first to fifth embodiments.

Figure 12A:
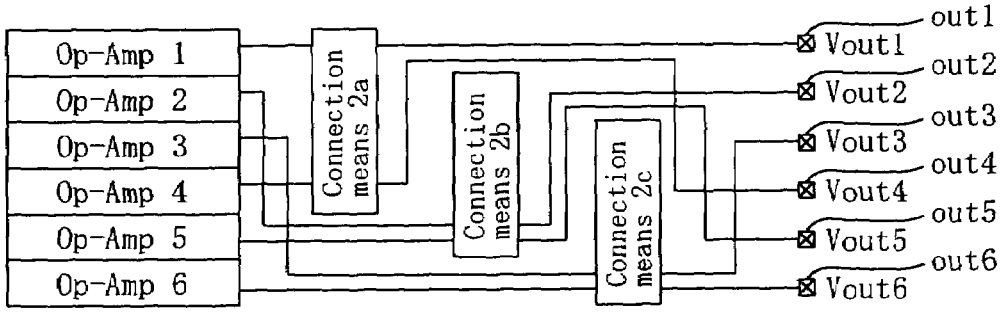
FIG. 12A is a block diagram illustrating a circuit layout of a signal line driving circuit of the present invention.
Figure 12B:
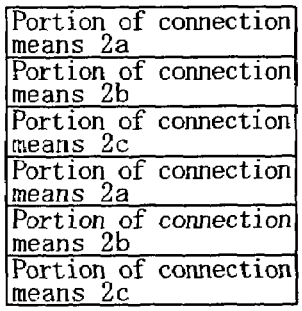
FIG. 12B illustrates a layout of connection means.
Figure 12C:
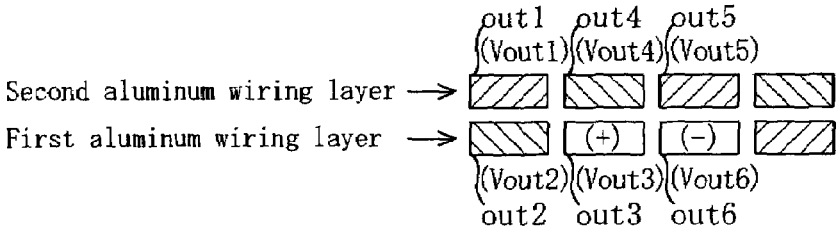
FIG. 12C illustrates a wiring structure of an output section of a signal line driving circuit according to a sixth embodiment of the present invention.

FIG. 12A is a block diagram illustrating a circuit layout of a signal line driving circuit of the present invention, FIG. 12B illustrates a layout of connection means, and FIG. 12C illustrates a wiring structure of the output section of the signal line driving circuit of the present invention.

First, as illustrated in FIG. 12A, the operational amplifiers Amp1, Amp2, . . . , for outputting R, G and B image-forming signals, for example, are arranged in a row in the output circuit of the signal line driving circuit of the present invention. R, G and B output sections are arranged in a repeating sequence of R, G and B, with connection means for connecting two voltage supply lines to each other being interposed between the operational amplifiers Amp1, Amp2, . . . , and the R, G and B output sections. Note that in an actual layout, the connection means are not shifted from one another as illustrated in FIG. 12A, but are arranged in a row, with each connection means being divided into portions, as illustrated in FIG. 12B.

A feature of the signal line driving circuit of the present embodiment is that the voltage supply lines are provided in the form of two aluminum wiring layers so that the potential difference between adjacent lines is large.

In the example illustrated in FIG. 12C, the output sections out2, out3 and out6 are arranged in this order from left to right in the first layer, while the output sections out1, out4 and out5 are arranged in this order from left to right in the second layer. In other words, the output sections are arranged so that those that are connected to adjacent panel-side signal lines (or sub-pixels), or those that are connected to panel-side signal lines (or sub-pixels) of the same color, are adjacent to each other.

In a dot inversion driving mode, signals of different polarities are applied to adjacent panel-side signal lines.

Therefore, in the output sections of the signal line driving circuit of the present embodiment, the potential difference between adjacent lines is large. In addition, the potential difference between a line in the first layer and another line in the second layer that overlaps with the line in the first layer is also large. As a result, during the product inspection process, it is relatively easy to detect defective products, as compared with a case where the potential difference between adjacent lines is small.

Note that similar effects can be obtained when the wire layout of the present embodiment is applied to the signal line driving circuits of the first and third embodiments or to the conventional signal line driving circuit.

Moreover, also when three or more wiring layers are provided, the product inspection process can be facilitated by arranging the output sections so that odd-numbered output sections are adjacent to each other while even-numbered output sections are adjacent to each other.

As described above, with the signal line driving circuit of the present embodiment, the product inspection process is facilitated, whereby it is possible to more reliably provide standard-compliant products to the user.

Seventh Embodiment

The seventh embodiment of the present invention will now be described below. The seventh embodiment of the present invention is directed to a signal line driving circuit with an improved circuit layout.

Figure 13:
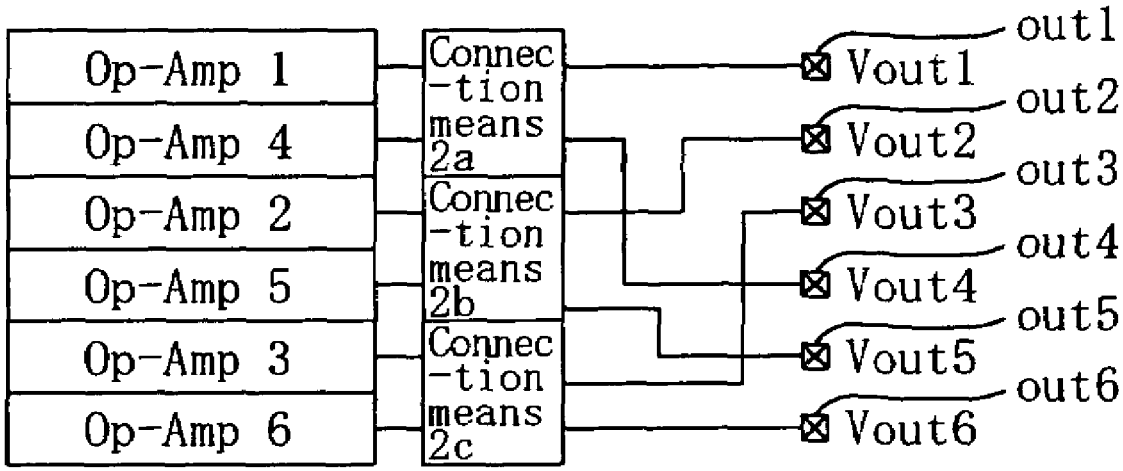
FIG. 13 is a block diagram illustrating a circuit layout of a signal line driving circuit according to a seventh embodiment of the present invention.
Figure 14:
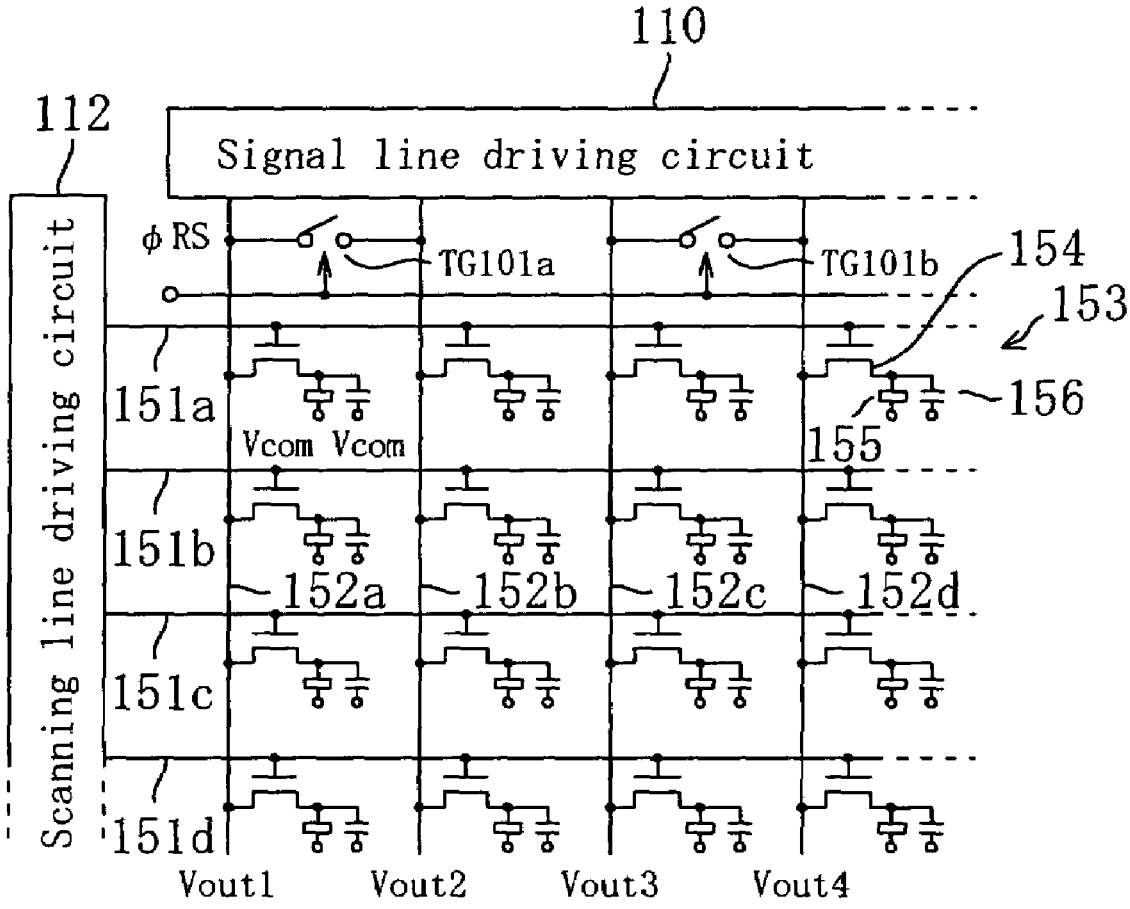
FIG. 14 PRIOR ART
FIG. 14 is a circuit diagram illustrating a conventional full-color liquid crystal display device.
Figure 15:
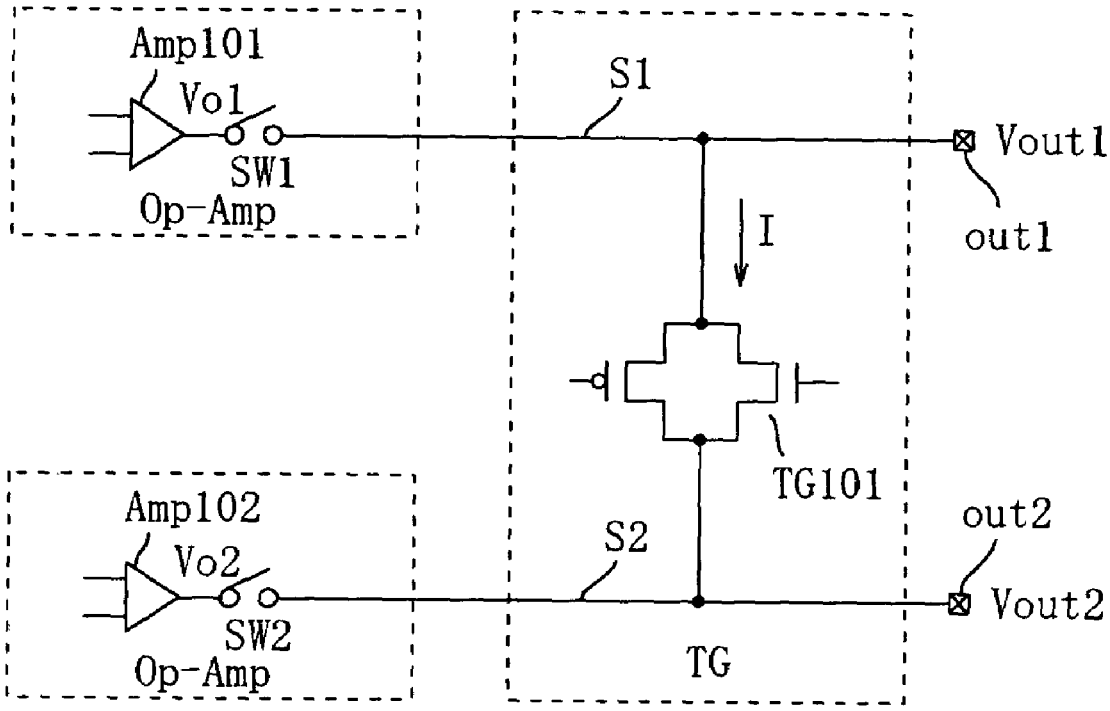
FIG. 15 PRIOR ART
FIG. 15 illustrates an output circuit of a conventional signal line driving circuit.
Figure 16:
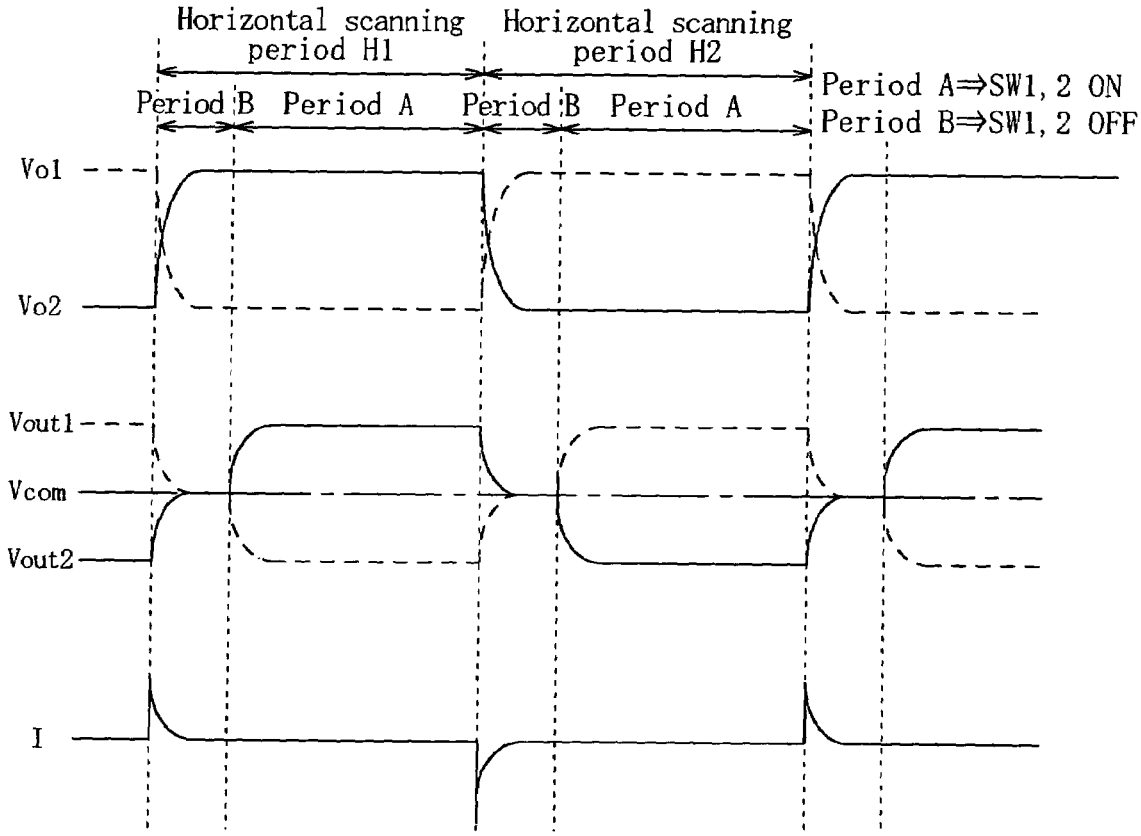
FIG. 16 PRIOR ART
FIG. 16 is a timing chart illustrating voltage transitions at various points in the conventional output circuit.
Figure 17:
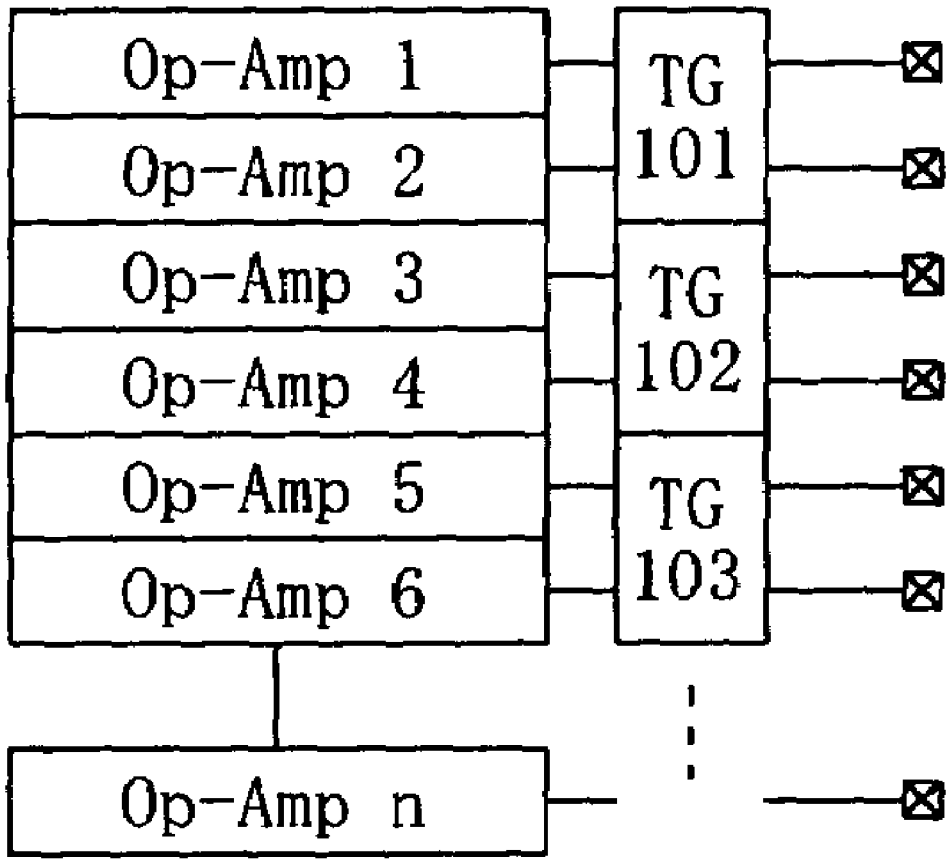
FIG. 17 PRIOR ART
FIG. 17 is a block diagram schematically illustrating a mask layout of the output circuit in the conventional signal line driving circuit.

FIG. 13 is a block diagram illustrating the circuit layout of the signal line driving circuit of the present embodiment.

The circuit layout illustrated in FIG. 13 is effective for cases where the $K^{th}$ (where $1 \leqq K+3 \leqq N$; K is a natural number) output section and the $(K+3)^{th}$ output section, i.e., output sections of the same color, are shorted with each other, as in the second and fourth embodiments, for example.

As illustrated in FIG. 13, in the output circuit of the signal line driving circuit of the present embodiment, the operational amplifiers Amp1 and Amp4 of the same color are adjacent to each other. Similarly, the operational amplifiers Amp2 and Amp5 (and the operational amplifiers Amp3 and Amp6) are adjacent to each other.

Using the circuit configuration of the second embodiment as an example, the connection means 2*a* connected to the operational amplifiers Amp1 and Amp4, the connection means 2*b* connected to the operational amplifiers Amp2 and Amp5, and the connection means 2*c* connected to the operational amplifiers Amp3 and Amp6 are arranged in this order.

The output sections out1, out2, . . . , connected to the connection means 2 are arranged so as to conform to the order in which the panel-side signal lines are arranged. The voltage supply lines in the two wiring layers extend between the connection means 2 and the output sections out1, out2, . . . , while crossing one another so that the arrangement of the output sections is aligned with that of the panel-side signal lines.

Note that while only six outputs are shown in FIG. 13, such a 6-output arrangement is repeated to form a multiple-output signal line driving circuit in a case where R, G and B pixels are used.

With the circuit layout of the present embodiment, crossing of lines between the operational amplifiers and the connection means can be reduced, whereby the layout of the connection means can be simplified.

Note that with this layout, lines connecting the connection means to the output sections need to cross one another. However, this is outweighed by the advantage of the simplified layout of the connection means.

Moreover, with the circuit layout of the present embodiment, the wire routing, etc., are reduced, thereby allowing for a reduction in the circuit area, as compared with the circuit layout illustrated in FIG. 12A.

Note that the wiring method of the sixth embodiment can be applied to the output sections of the signal line driving circuit of the present embodiment.

What is claimed is:

1. A display device driving circuit for use with a display device having a display section including sub-pixels arranged in a matrix pattern and a plurality of signal lines for supplying image-forming signals to the sub-pixels, the display device driving circuit comprising:

voltage supply lines for transferring the image-forming signals to the plurality of signal lines;

switches for turning ON/OFF the transfer of the image-forming signals to the voltage supply lines; and shorting means for electrically shorting one of the voltage supply lines that is connected to an odd-numbered one of the plurality of signal lines with another one of the voltage supply lines that is connected to an even-numbered one of the plurality of signal lines during a predetermined period including a period during which the switches are OFF, wherein the shorting means is configured to be turned OFF autonomously when a polarity of a potential of the voltage supply line connected to the odd-numbered signal line and a polarity of a potential of the voltage supply line connected to the even-numbered signal line are switched around, the shorting means includes:

a shorting line for electrically connecting the voltage supply line connected to the odd-numbered signal line to the voltage supply line connected to the even-numbered signal line during the predetermined period;

a switching element provided along the shorting line and including a control section; and a control element for performing a control so that the potential of the voltage supply line connected to the odd-numbered signal line is applied to the control section at least during the predetermined period, the switching element is a first MISFET of a first conductivity type, with the control section being a gate electrode of the switching element; and the control element includes a second MISFET of a second conductivity type provided between the voltage supply line connected to the odd-numbered signal line and the gate electrode of the switching element, and a third MISFET of the second conductivity type provided between the voltage supply line connected to the even-numbered signal line and the gate electrode of the switching element.

2. The display device driving circuit of claim 1, wherein the odd-numbered signal line and the even-numbered signal line are adjacent to each other.

3. The display device driving circuit of claim 1, wherein the voltage supply lines are all electrically shorted together during the predetermined period.

4. The display device driving circuit of claim 1, wherein:

the sub-pixels include groups of sub-pixels for different colors to be displayed; and the voltage supply line connected to the odd-numbered signal line and the voltage supply line connected to the even-numbered signal line supply the image-forming signals for driving the sub-pixels of the same color.

5. The display device driving circuit of claim 4, wherein:

the signal lines include three groups of signal lines for red, green and blue; and the $K^{th}$ signal line and the $(K+3)^{th}$ signal line are electrically shorted with each other by the shorting means, where K is any natural number.

6. The display device driving circuit of claim 4, wherein voltage supply lines that are for supplying the image-forming signals to the sub-pixels of the same color are all electrically shorted together during the predetermined period.

7. The display device driving circuit of claim 4, wherein:

the display device driving circuit further comprises a plurality of operational amplifiers arranged in a row for transferring the image-forming signals to the switches; and one of the plurality of operational amplifiers that is for outputting the image-forming signal to be supplied to the $K^{th}$ signal line is adjacent to another one of the plurality of operational amplifiers that is for outputting the image-forming signal to be supplied to the $(K+3)^{th}$ signal line.

8. The display device driving circuit of claim 1, wherein:

a polarity of each of the image-forming signals is inverted for every horizontal scanning period; and a control is performed so that either the potential of the voltage supply line connected to the odd-numbered signal line or the potential of the voltage supply line connected to the even-numbered signal line is applied to the control section of the switching element throughout the horizontal scanning period.

9. The display device driving circuit of claim 1, wherein:

the control element further includes a fourth MISFET of the first conductivity type provided between a ground and a gate electrode of the first MISFET for turning OFF the switching element except during the predetermined period; and a line connecting the fourth MISFET to the gate electrode of the first MISFET is connected to the second MISFET and the third MISFET.

10. The display device driving circuit of claim 1, wherein:

connecting portions of the voltage supply lines for connecting the voltage supply lines to the plurality of signal lines are provided in a plurality of wiring layers; and the connecting portions are provided so that those that are connected to adjacent ones of the plurality of signal lines, or those that are connected to ones of the plurality of signal lines of the same color, are adjacent to each other in the same wiring layer.

11. The display device driving circuit of claim 1, wherein:

connecting portions of the voltage supply lines for connecting the voltage supply lines to the plurality of signal lines are provided in a plurality of wiring layers; and among the connecting portions, those that are connected to adjacent ones of the plurality of signal lines, or those that are connected to ones of the plurality of signal lines of the same color, are separately provided in a first one of the plurality of wiring layers and in a second one of the plurality of wiring layers, the second wiring layer being immediately above the first wiring layer, and are arranged so as to overlap with each other as viewed from above.

12. The display device driving circuit of claim 1, wherein a polarity of the image-forming signals to be supplied to the odd-numbered signal line is opposite to that of the image-forming signals to be supplied to the even-numbered signal line.

13. A display device driving circuit for use with a display device having a display section including sub-pixels arranged in a matrix pattern and a plurality of signal lines for supplying image-forming signals to the sub-pixels, the display device driving circuit comprising:

voltage supply lines for transferring the image-forming signals to the plurality of signal lines;

switches for turning ON/OFF the transfer of the image-forming signals to the voltage supply lines; and shorting means for electrically shorting one of the voltage supply lines that is connected to an odd-numbered one of the plurality of signal lines with another one of the voltage supply lines that is connected to an even-numbered one of the plurality of signal lines during a predetermined period including a period during which the switches are OFF, wherein the shorting means is configured to be turned OFF autonomously when a polarity of a potential of the voltage supply line connected to the odd-numbered signal line and a polarity of a potential of the voltage supply line connected to the even-numbered signal line are switched around, and the shorting means includes:

a first shorting line and a second shorting line for electrically connecting the voltage supply line connected to the odd-numbered signal line to the voltage supply line connected to the even-numbered signal line during the predetermined period;

a first switching element provided along the first shorting line, wherein the first switching element is turned ON only when the potential of the voltage supply line connected to the odd-numbered signal line is equal to or greater than the potential of the voltage supply line connected to the even-numbered signal line, and is turned OFF autonomously when the potential of the voltage supply line connected to the odd-numbered signal line is less than the potential of the voltage supply line connected to the even-numbered signal line, and the first switching element includes a MISFET of a first conductivity type whose gate electrode is connected to the first shorting line, and a first transfer gate; and a second switching element provided along the second shorting line, wherein the second switching element is turned ON only when the potential of the voltage supply line connected to the even-numbered signal line is equal to or greater than the potential of the voltage supply line connected to the odd-numbered signal line, and is turned OFF autonomously when the potential of the voltage supply line connected to the even-numbered signal line is less than the potential of the voltage supply line connected to the odd-numbered signal line, and the second switching element includes a MISFET of the first conductivity type whose gate electrode is connected to the second shorting line, and a second transfer gate.

14. The display device driving circuit of claim 13, wherein:

the first switching element includes a first diode and a third transfer gate; and the second switching element includes a fourth transfer gate and a second diode, wherein the first diode and the second diode are arranged in opposite directions to each other with respect to a first output section and a second output section.

* * * * *